US006041129A

United States Patent [19]

Adelman

[11] Patent Number: 6,041,129

[45] Date of Patent: Mar. 21, 2000

[54] HEARING APPARATUS

[76] Inventor: Roger A. Adelman, 957 Riverwatch Dr., Villa Hills, Ky. 41017-3769

[21] Appl. No.: 08/599,445

[22] Filed: Jan. 18, 1996

Related U.S. Application Data

[63] Continuation of application No. 08/303,161, Sep. 8, 1994, abandoned.

[51] Int. Cl.[7] ..... H04R 25/00

[52] U.S. Cl. ..... 381/328; 381/322; 381/324

[58] Field of Search ..... 381/68, 68.6, 68.7, 381/69, 69.1, 69.2, 183, 187, 312, 313, 322, 324, 327, 328, 151, 380; 181/129, 130, 135; 600/25; 607/56, 57

[56] References Cited

U.S. PATENT DOCUMENTS

| | | | |
|---|---|---|---|
| Re. 26,258 | 8/1967 | Martin | 381/68.6 |
| 1,582,473 | 4/1926 | Kay et al. . | |
| 1,630,028 | 5/1927 | Reynolds . | |
| 1,699,786 | 1/1929 | Goldsborough . | |
| 1,732,351 | 10/1929 | Borkman . | |
| 1,738,853 | 12/1929 | Thayer . | |
| 1,829,355 | 10/1931 | Houghton . | |
| 1,984,439 | 12/1934 | Stapler . | |
| 2,069,242 | 2/1937 | Graham . | |
| 2,439,665 | 4/1948 | Marquis . | |
| 2,442,791 | 6/1948 | Wente . | |
| 2,848,560 | 8/1958 | Wiegand et al. | 381/68 |
| 2,964,596 | 12/1960 | Christensen | 381/68.6 |
| 3,013,905 | 12/1961 | Gamzon et al. . | |
| 3,066,200 | 11/1962 | Pavlak . | |
| 3,141,071 | 7/1964 | Rich . | |
| 3,170,046 | 2/1965 | Leale . | |
| 3,346,704 | 10/1967 | Mahoney . | |
| 3,366,748 | 1/1968 | Ashworth . | |
| 3,389,232 | 6/1968 | Posen et al. | 381/328 |
| 3,414,685 | 12/1968 | Geib et al. | 381/68.6 |
| 3,423,543 | 1/1969 | Kompanek . | |
| 3,527,901 | 9/1970 | Geib . | |
| 3,557,775 | 1/1971 | Mahoney . | |
| 3,563,337 | 2/1971 | kawamura . | |
| 3,712,962 | 1/1973 | Epley . | |
| 3,746,789 | 7/1973 | Alcivar . | |
| 3,764,748 | 10/1973 | Branch et al. . | |
| 3,852,540 | 12/1974 | Diethelm . | |
| 3,870,832 | 3/1975 | Frederickson . | |
| 3,873,784 | 3/1975 | Doschek . | |
| 3,882,285 | 5/1975 | Nunley et al. . | |
| 3,890,474 | 6/1975 | Glicksberg . | |
| 3,919,499 | 11/1975 | Winey . | |
| 3,927,279 | 12/1975 | Nakamura et al. | 381/68.2 |
| 3,983,337 | 9/1976 | Babb . | |
| 4,068,090 | 1/1978 | Komatsu et al. . | |
| 4,150,262 | 4/1979 | Ono . | |
| 4,210,786 | 7/1980 | Winey . | |

(List continued on next page.)

*Primary Examiner*—Huyen Le
*Attorney, Agent, or Firm*—Dinsmore & Shohl LLP

[57] ABSTRACT

A hearing aid is configured and dimensioned so as to be inserted past the cartilaginous part of the external auditory canal (external acoustic meatus) and into the bony part of the external auditory canal. The outer portion of the hearing aid fits snugly into the cartilaginous part of the external auditory canal; the microphone is located at the acoustic focus of the ear such that the natural sound and direction gathering functions of the human outer ear are fully utilized by the hearing aid. The inner portion of the hearing aid is articularly joined to the outer portion to enable the inner portion to be positioned past the sigmoid portion of the external auditory canal and forms a soft covered, elongated speaker which fits within part of the bony part of the external auditory canal, without causing discomfort to the human user. The hearing aid can be equipped with hand-held radio-controlled volume and tone controls (or a local, self-contained volume control), and it can also utilize a radio link to enable enhanced real-time signal processing of the incoming sound information via a remote processor. Additionally, the hearing aid can be equipped with an accelerometer to either cancel or enhance, depending on the human user's needs, conductive (through the bone) portions of sound information.

3 Claims, 21 Drawing Sheets

U.S. PATENT DOCUMENTS 4,228,327 10/1980 Sawafuji .
4,276,452 6/1981 Suyama et al. .
4,284,856 8/1981 Hochmair et al. .
4,324,312 4/1982 Durbin .
4,329,676 5/1982 McDonald et al. .
4,334,315 6/1982 Ono et al. .
4,357,497 11/1982 Hochmair et al. .
4,433,214 2/1984 Jasinski .
4,471,172 9/1984 Winey .
4,471,490 9/1984 Ballafiore .
4,480,155 10/1984 Winey .
4,520,236 5/1985 Gauthier .
4,539,440 9/1985 Sciarra .
4,622,692 11/1986 Cole .
4,637,402 1/1987 Adelman .
4,653,103 3/1987 Mori et al. .
4,703,510 10/1987 Larson .
4,706,778 11/1987 Topholm .
4,718,096 1/1988 Meisel .
4,723,296 2/1988 Nieuwendijk et al. .
4,735,759 4/1988 Bellafiore .
4,759,070 7/1988 Voroba et al. .
4,800,982 1/1989 Carlson .
4,802,228 1/1989 Silverstein et al. .
4,808,945 2/1989 Waldhauser et al. .
4,817,609 4/1989 Perkins et al. .
4,829,581 5/1989 Nieuwendijk et al. .
4,845,755 7/1989 Busch et al. .
4,845,757 7/1989 Wagner .
4,868,517 9/1989 Walhauer et al. .
4,870,688 9/1989 Voroba et al. .
4,880,076 11/1989 Ahlberg et al. .
4,882,761 11/1989 Waldhauer .
4,882,762 11/1989 Waldhauer .
4,901,354 2/1990 Gollman et al. .
4,920,570 4/1990 Wesit et al. .
4,937,876 6/1990 Biermans .
4,947,432 8/1990 Tpholm .
4,962,537 10/1990 Basel et al. .
5,125,032 6/1992 Meister et al. .
5,390,254 2/1995 Adelman ..... 381/68.6

HEARING APPARATUS

This is a continuation of application Ser. No. 08/303,161, filed Sep. 8, 1994, now abandoned.

TECHNICAL FIELD

The present invention relates generally to hearing aids and listening devices and is particularly directed to a hearing aid that is physically dimensioned and configured to fit inside the external auditory canal (external acoustic meatus). The invention will be specifically disclosed in connection with a miniature hearing aid which has an outer portion located at the acoustic focus of the concha, having a microphone at this important focal point, and which has an inner portion located partially within the bony part of the external auditory canal, having an elongated speaker that is "closely-coupled" to the tympanic membrane.

BACKGROUND ART

Hearing aids are generally well-known in the art and in wide spread use. In a typical hearing aid, a microphone is used to pick up sound waves and convert that information into electrical signals. An audio amplifier magnifies the electrical signals within the frequencies of interest (20 Hz to 20 KHz), and then sends the amplified signals to a speaker located at the inner portion of the hearing aid. The speaker converts the electrical signals back into sound waves. In technical literature concerning hearing aids, speakers are often referred to as "receivers".

Many conventional hearing aids are relatively large devices that are quite visible to other persons. A recent trend has been to make the hearing aid as small as possible, and to place a portion of it inside the ear where it is not visible. There are several patents which disclose hearing aids that ostensibly fit within the external auditory canal. It must be noted that, even in such patented inventions disclosing "in-the-canal" hearing aids, a portion of the hearing aid is visible and noticeable to other persons because the speaker and the electronics are too large to fit within the external auditory canal. One exception is disclosed in U.S. Pat. No. 4,817,609 by Perkins, wherein the external auditory canal is surgically enlarged so that the disclosed hearing aid can fit deep inside the canal, thereby showing very little to outside observers. Such surgery is an extraordinary remedy that most human users would wish to avoid if a more satisfactory hearing aid were available.

Other U.S. Patents that disclose hearing aids which ostensibly fit within the external auditory canal do not depict the exact anatomy of the external auditory canal. The external auditory canal (external acoustic meatus) leads from the concha (the "bowl" of the ear) to the tympanic membrane (eardrum). The outer one-third of the canal is cartilaginous, and the inner two-thirds is bony. The canal is not straight, but in the horizontal plane (a Transverse Section—see FIG. 3A) it takes a sharp turn, approximately 90°, toward the rear, and then a milder turn back toward the front as the path is traced from the concha toward the tympanic membrane. The area containing these "S-shaped" turns is designated the sigmoid portion of the cartilaginous part of the external auditory canal. Hearing aids that are disclosed as "straight" in overall shape are just not able to be located within the external auditory canal. Three patents that disclose such hearing aids are U.S. Pat. No. 4,520,236, by Gauthier, No. 4,539,440, by Sciarra, and No. 4,706,778, by Topholm.

The Gauthier patent describes a hearing aid that snugly fits inside the external auditory canal, apparently including the bony part of the canal. The hearing aid appears (from the drawings) to extend the entire length of the auditory canal, virtually against the tympanic membrane; such a device would surely be very uncomfortable to wear. Additionally, the Gauthier patent discloses the use of an earmold that would contain the device. Unless the earmold was very flexible, it would be impossible to insert the hearing aid into its intended location inside the external auditory canal; a "straight" configuration needed to snugly fit into the inner (bony) part of the canal would not be able to be placed through the sigmoid portion of the external auditory canal.

The Sciarra patent describes a hearing aid that has an adjustable diameter, which can be expanded (enlarged) in order to fit snugly inside the external auditory canal. The patent does not disclose precisely where the hearing aid is to sit in the canal. Since the drawings illustrate a "straight" device, it obviously cannot be placed very far into the canal, because it would not be able to make it through the sigmoid portion of the external auditory canal.

The Topholm patent describes a hearing aid that has a hollow space at its innermost tip, which acts as a resonance chamber by enhancing the device's frequency response in the 1000 Hz to 5000 Hz range. The patent does not disclose the location in the external auditory canal wherein the hearing aid is to be placed, nor does it disclose the exact shape of the entire hearing aid. All that is disclosed is a general tubular shape of the innermost tip, and it appears to fit somewhere in the cartilaginous part of the external auditory canal.

Another U.S. patent which discloses a hearing aid that ostensibly fits in the external auditory canal is U.S. Pat. No. 4,937,876, by Biermans. This patent does not disclose where the hearing aid is to sit in the external auditory canal. The drawings disclose a device which has a "receiver" (speaker) near its innter tip, with such speaker aiming directly toward the tympanic membrane. It is clear, however, that the speaker is too large in diameter to fit through the sigmoid portion of the external auditory canal, and therefore, this invention merely fits into the exterior opening of the external auditory canal with the major portion of hearing aid sticking outside the area of the concha.

It is important to note that, in order to minimize distortion in sound energy transferred to the tympanic membrane, a hearing aid speaker should have a surface area equal or greater than the surface area of the tympanic membrane. Since the surface area of the tympanic membrane is at least as great as an oblique cross-section area of the external auditory canal (as can be seen in FIGS. 3A and 4A of the present invention), it is therefore, obvious that a miniature speaker whose face is pointed directly at the tympanic membrane (as in the Biermans patent) must be at least as large as the cross-section area of the external auditory canal. The inevitable conclusion is that such a speaker cannot possibly fit past the sigmoid portion of the cartilaginous part of the external auditory canal.

The above four patents attempt to disclose hearing aids that are to be located in the external auditory canal. It is clear, however, from their general shape and size that a major portion of each of these devices must stick out of the ear in a manner that would be visible to others. Either the device is too "straight" to fit past the sigmoid portion of the external auditory canal, and/or the electrical components (including a battery) must reside outside the sigmoid portion of the canal due to their large overall size. Hence, the need for a miniature hearing aid that is small enough and properly shaped to fit deep inside the external auditory canal (without requiring ear surgery) has not yet been met by the above patented devices.

An improvement in the art was disclosed in U.S. Pat. No. 4,870,688, by Voroba. The Voroba patent describes a modular hearing aid which is shaped (and sized) to partially fit in the external auditory canal such that a large portion of the device is hidden from view by an outside observer. A portion of the device extends into the inner portion of the canal past the sigmoid portion of the external auditory canal. As the Voroba patent discloses, it is desirable to have the hearing aid extend further into the external auditory canal since the closer the hearing aid is to the tympanic membrane (eardrum), the greater the effective sound output of the hearing aid. The Voroba hearing aid uses a number of "hard" components, having individual geometries which provide for the accommodation of anatomical variations in individual users. The collection of modular hard parts are at least partially enclosed and extended by a compliant covering. The covering of the inner portion of the Voroba hearing aid is made of soft (compliant) material, and it may penetrate up to ¾ of the length of the external auditory canal, thereby increasing the effective gain of the hearing aid by 6 to 10 dB over conventional "in-the-canal" hearing aids.

It must be noted, however, that the Voroba invention does not place its speaker at the innermost portion of the device. The speaker is, instead, located further toward the outer portion of the device (approximately in the center of the device according to the drawings), and a sound-carrying tube, surrounded by soft, resilient material, extends to the innermost tip of the device. In effect, the speaker (called a "receiver" in the Voroba patent) emits sound waves into the tube, and the tube acts as a passive wave guide toward the inner portion of the external auditory canal, and toward the tympanic membrane. The Voroba patent, therefore, only teaches the concept used in the prior art of having passive elements in the innermost portion of the hearing aid. Such passive elements are merely space-consuming conduits which transfer the acoustic energy from the active, sound-generating surface of the speaker. The air inside such passive element is compressible, so this system still lacks a certain amount of efficiency, and compromises the faithful reproduction of the soundwave at the tympanic membrane. In essence, the overall system of hearing aid speaker to tympanic membrane is not "closely-coupled."

Close coupling of an acoustic source to the tympanic membrane is necessary for the realization of the beneficial attributes gleaned by signal processing for the treatment of hearing deficit. Devices in the prior art for generalized signal processing, including U.S. Pat. No. 4,637,402 by Adelman, and U.S. Pat. Nos. 4,882,762, and 4,882,761 by Waldhauer, demonstrate optimization techniques for manipulating the electronic representation of the audio signal, but fail to provide optimal presentation as a sound wave to the tympanic membrane. Thus, generalized signal processing techniques of the prior art are limited by the ability of the output transducing device (the speaker) and, therefore, are not closely coupled systems.

To achieve a more closely-coupled system, the amount of compliant material between the active face of the speaker and the receptive face of the tympanic membrane must be kept to a minimum. The best method to achieve such a system is to reduce the volume of air (thereby reducing the amount of compliant material) contained in the active path of the sound waves. The beneficial effects of such a system are (1) better bandwidth, (2) greater efficiency of energy transmission, and (3) reduced distortion of the auditory signal. A better method for achieving such a closely-coupled system is to locate the active speaker itself inside the external auditory canal, as close to the eardrum as feasible, while also keeping the amount of compliant material (the amount of air volume) in the system to a minimum.

SUMMARY OF THE INVENTION

Accordingly, it is a primary object of the present invention to provide a hearing aid that is properly shaped, sized, and oriented to fit within the external auditory canal, causing the speaker element to fit in the canal at a point between the sigmoid portion of the canal and the tympanic membrane.

It is another object of the present invention to provide a hearing aid that is properly shaped, sized and oriented to fit within the external auditory canal, with the speaker element located in the canal between the sigmoid portion of the canal and the tympanic membrane, whereby the hearing aid is covered by a disposable boot that prevents contamination and seals the external auditory canal so that the volume of air between the hearing aid and the tympanic membrane is held constant.

It is yet another object of the present invention to provide a hearing aid that is properly shaped, sized, and oriented to fit within the external auditory canal, whereby the speaker element has an elongated shape so as to not only fit deeply in the canal between the sigmoid portion of the external auditory canal and the tympanic membrane, but also to allow the speaker to exhibit a "high-fidelity" frequency response in the human hearing range of 20 Hz to 20 KHz, and to minimize distortion.

A further object of the present invention is to provide a hearing aid which has an inner portion that is properly shaped, sized, and oriented to fit within the external auditory canal, whereby the outer portion (the microphone and the electrical, electronic, and signal processing components) may be miniaturized to an extent that, while it is in use, the outer portion of the hearing aid is barely noticeable to another person who is observing the user.

A yet further object of the present invention is to provide a hearing aid which has an inner portion that is properly shaped, sized, and oriented to fit within the external auditory canal, whereby the microphone in the outer portion is located at the acoustic focus of the concha, thereby utilizing the natural sound gathering and direction locating anatomical features of the human ear to the greatest possible extent.

A still further object of the present invention is to provide a hearing aid that is properly shaped, sized, and oriented to fit within the external auditory canal, whereby the external tip of the hearing aid at the microphone contains a large on-off control which can be actuated by the fingertip of the human user, and can also be used as a volume control, and a "treble-bass" filter control.

It is yet another object of the present invention to provide a hearing aid that is properly shaped, sized, and oriented to fit within the external auditory canal and has its microphone at the acoustic focus of the concha, whereby a hand-held transmitter is used to adjust the volume level and the treble-bass filter of the hearing aid. Such a hand-held transmitter could use radio frequency electromagnetic radiation to carry the necessary information to the hearing aid, or it could use other wavelengths of electromagnetic radiation to carry the information, such as ultraviolet, infrared, or microwave frequencies. Ultrasonic sound waves could even be used to perform the above task.

It is still another object of the present invention to provide a hearing aid that is properly shaped, sized, and oriented to fit within the external auditory canal and has its microphone at the acoustic focus of the concha, whereby a radio link is also used to provide signal processing by a remote computer linked to the hearing aid. Such signal processing can be used to enhance certain frequencies, remove background noise, or to remove other unwanted sound patterns.

A still further object of the present invention is to provide a hearing aid that is capable of amplifying or attenuating the conductive sound (conducted through the bones) that is created by the human user's own voice.

A yet further object of the present invention is to provide a hearing aid that is properly shaped, sized, and oriented to fit within the external auditory canal, and to combine a radio receiver as an input to the amplifier such that the hearing aid speaker would output both information received from a radio station, and sound wave information received by the hearing aid input microphone (at a reduced volume, if desired). Such received radio frequencies could be in the commercial AM and FM bands.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved hearing aid is provided having substantially small overall size and the correct shape to fit in the external auditory canal of the human ear. The speaker element of the hearing aid is placed within the canal at a point between the sigmoid portion of the canal and the tympanic membrane. The hearing aid is covered by a disposal boot that prevents contamination of the functional parts of the hearing aid and seals the external auditory canal around the hearing aid so that the volume of air between the hearing aid and the tympanic membrane is held constant. The central portion of the boot consists of a deformable material, so that one size of hearing aid will fit most human users. This deformable material tends to retain its original size and shape, such that it will press snugly against the inner diameter of the external auditory canal of the user's ear, particularly at the entrance to the external auditory canal. This deformable material seal also serves as a sound insulator which prevents feedback from the speaker to the microphone of the hearing aid.

The fact that the deformable boot tends to seal the volume of air inside the external auditory canal, between the point that the hearing aid makes contact with the inner membrane of the user's ear and the tympanic membrane, is important to achieve a closely-coupled system. As discussed above, to achieve a closely-coupled system, the amount of compliant material between the active face of the speaker and the receptive face of the tympanic membrane must be kept to a minimum. By sealing the volume of air inside the overall system that consists of the hearing aid, the air column, and the tympanic membrane, the amount of compliant material (the air) is minimized and kept constant, so that motion at the speaker is accommodated only by a responsive motion of the tympanic membrane, along with avoiding unwanted resonances in the small volume of trapped air.

In accordance with a further aspect of the invention, the speaker element of the hearing aid has an elongated shape so as to not only fit in the external auditory canal between the sigmoid portion of the cartilaginous part of the external auditory canal and the tympanic membrane, but also to have a large enough surface area to cause a sympathetic vibration of the tympanic membrane. Such large sound generating surface enables the speaker to produce sound energy which is largely devoid of harmonic distortion in the normal human hearing range of 20 Hertz to 20 Kilohertz. The overall cross sectional shape of the speaker element is generally that of a flattened tube. The acoustic output of the speaker is created by a speaker membrane which is driven by an electromagnetic linear motor. In one embodiment, the linear motor consists of a permanent magnetic field and an oval-shaped current-carrying coil which is disposed within the magnetic field. The coil is permanently affixed to the speaker membrane (its face), forming an armature. A portion of the speaker structure consists of one or more resonance cavities on the interior of the speaker membranes tunably suitable for the enhancement of certain portions of the frequency spectrum. The speaker must consist of at least one armature that forms the speaker's face, however, in a second embodiment, there are two separate faces, on opposite sides of the speaker. Each of these two faces may have its own resonance cavity and its own compliant properties, thereby allowing each speaker face to be used for the enhancement of a different portion of the frequency spectrum, such as treble or bass.

According to a further aspect of the invention, the speaker membrane is in the form of an oval plane and has compliance enhancing ripples near its attachment edges. A substantial portion of the plane is movable as a rigid body, yet the ripples near its attachment edges greatly enhance the performance of the speaker in the form of greater efficiency.

In yet a further aspect of the invention, the overall speaker portion of the hearing aid is articulated at its attachment point to the rest of the main body of the hearing aid. This allows the speaker element to fit past the sigmoid portion of the external auditory canal, and thereby allows the entire speaker to fit inside the canal.

In yet another aspect of the invention, the remaining components of the hearing aid, i.e., the microphone and the electrical components, are miniaturized to the extent that the entire hearing aid is barely visible to another person who is observing the user. This is made possible by constructing the hearing aid such that the entire speaker element fits inside the external auditory canal, and the portion of the hearing aid that contains the battery and the electronic components fits at the very entrance of the canal, such that the microphone is located at the acoustic focus of the concha. As discussed above, the shape of the hearing aid and the configuration and orientation of its elements is very important so that the desired location of its placement in a human ear is possible. As practiced by this invention, the entire hearing aid is substantially out of sight of another observer, except for the microphone itself, which is at the very entrance of the external auditory canal (i.e., at the acoustic focus of the concha). By locating the active elements of the entire hearing aid deeper in the external auditory canal, the hearing aid does not protrude out from the concha, and therefore, cannot be seen by others.

In yet another aspect of the invention, the microphone is located at the acoustic focus of the concha. This arrangement maximizes the natural sound gathering and direction locating anatomical features of the human ear. Since the concha (the "bowl" of the ear) is naturally designed to be the focal point of sound entering the human ear, its acoustic focal point is also the logical location for a microphone of a hearing aid. Until the present invention, however, no hearing aid has been able to place the microphone specifically at this point. While the type of microphone used in this invention is not crucial, it must, however, be small in size in order to fit inside the concha, and it should also operate using little electrical power. Two microphones technologies that have been successfully utilized in this invention are the electret, and the piezo-electric types.

In a further aspect of the invention, the electronics of the hearing aid include volume and tone (treble - bass) functions. The volume function can have an automatic gain control circuit, and the gain of the electronics can either be linear or non-linear, as necessary, to minimize or eliminate distortion.

In accordance with yet another aspect of the invention, the external prominence of the hearing aid, essentially at the location of the microphone, contains an on/off control which can be actuated by the fingertip of the human user. Fingertip actuation of this control also provides a volume control and treble-bass filter control in one embodiment.

In accordance with a still further aspect of the invention, a hand-held transmitter is used to adjust the volume level and the treble-bass filter of the hearing aid. In one embodiment the hand-held transmitter uses radio frequency electromagnetic radiation to carry the necessary information to the hearing aid. In a second embodiment, the transmitter uses electromagnetic radiation in the infrared frequency spectrum to carry the necessary information to the hearing aid. It is obvious that any safe frequency of electromagnetic radiation could be used to carry the necessary information to the hearing aid over the short range required. Ultrasonic sound waves could even be used to perform this task.

According to yet another aspect of the present invention, a single-part hearing aid (which includes substantially the same elements as in the single-part hearing aid described above) is combined with a self-contained enhanced signal processing unit. Such enhanced signal processing can remove background noise, enhance certain frequencies, or remove other unwanted sound patterns. This aspect of the invention can be utilized to greatly enhance the performance of the hearing aid for persons having particularly profound hearing dysfunction.

According to a yet further aspect of the invention, a radio link is used to provide enhanced signal processing to the hearing aid. Such signal processing is performed by a remote signal processing unit which can be used to enhance certain frequencies, remove background noise, or also to remove other unwanted sound patterns. The radio link would be best utilized as a simultaneous two-way link (full duplex) whereby the original sound is captured by the microphone of the hearing aid portion of this system (which consists of substantially the same elements as in the single-part hearing aid described above), then transmitted by the radio link to the signal processing portion of this system. The signal processing portion can be a portable unit, strapped to the user's clothing, or it can be a stationary unit for non-mobile use. After processing, the information is retransmitted from the signal processing portion by radio link back to the hearing aid portion for transfer to the speaker output of the hearing aid. This remote enhanced signal processing portion is available when the electronic elements are too large in size, or are too great in electrical power consumption to fit within the anatomical limitations of the above-described single part hearing aid. This aspect of the invention can be utilized to greatly enhance the performance of the hearing aid for persons having particularly profound hearing dysfunction.

According to a still further aspect of the invention, use of an accelerometer or other rigid body motion sensing device cancels or enhances the conductive sound that is created by the human user's own voice. Such sound waves are conducted through the solid structure of the speaker's head into the temporal bone, which conducts the sound waves directly into the cochlea of that speaker's ear. Depending upon the hearing needs of the particular user of the hearing aid, such conductive sound would be best enhanced or attenuated by the hearing aid. In this aspect of the invention, the accelerometer or other rigid body motion sensor is attached to the surface of the hearing aid at a point where it most closely comes in contact with the solid portion of the external auditory canal. In this way, the accelerometer can sense directly the conductive sound waves created by the human user's own voice. Such sound waves would then be either amplified or attenuated, and then mixed with air-borne sound detected by the microphone according to the user's needs. The degree of amplification, attenuation, or mixing could be controlled by the previously mentioned hand-held transmitter, or through a separate control that the user could actuate with his fingertip.

In yet a still further aspect of the invention, a radio receiver is also placed inside the hearing aid such that the hearing aid speaker would output information received from both the radio station, and sound wave information received by the hearing aid input microphone. The most common set of radio frequencies that would be received would be the commercial AM and FM bands of frequencies. Once again, it would be desirable to be able to adjust the volume of the received radio frequencies independent of the volume received by the microphone. Such volume controls could be located in the previously mentioned hand-held transmitter, or by a fingertip control.

In accordance with another aspect of the invention, no external air vent is required to tune the acoustical pathway between the speaker and the eardrum. The possibility of "whistling," because of feedback from the speaker to the microphone, via that type of conduit is entirely eliminated. Very high amplification is thus possible in a miniaturized hearing aid that fits in the external auditory canal without the bothersome quality of "whistling."

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings:

FIG. 1A is a cross-sectional elevation view of the entire device constructed in accordance with the principles of the present invention;

FIG. 1B is a top plan view of the hearing aid device of FIG. 1A;

FIG. 1C is an elevational view of the hearing aid device of FIG. 1A, showing the details of a disposable boot in cross-section, including its deformable material portion;

FIG. 1D is a partial cross-sectional view taken along line 1D–1D of FIG. 1A;

FIG. 1E is a bottom plan view of the hearing aid device of FIG. 1A, illustrating a loop antenna in the base;

FIG. 5A is a plan view of the speaker portion of the hearing aid device of FIG. 1A, and a cross-sectional view of its articulated joint;

FIG. 5B is a longitudinal cross-section view of the speaker portion, taken along line 5B—5B of FIG. 5A;

FIG. 5C is a sectional view of the speaker portion, taken along line 5C—5C of FIG. 5B;

FIG. 6A is a plan view of the speaker cover of FIG. 5A;

FIG. 6B is a cross-sectional elevation view of the speaker cover, taken along line 6B—6B of FIG. 6A;

FIG. 6C is a cross-sectional elevation view of the speaker cover, taken along line 6C—6C of FIG. 6A;

FIG. 7A is a plan view of the speaker armature of FIG. 5A;

FIG. 7B is a cross-sectional elevation view of the armature, taken along line 7B—7B of FIG. 7A;

FIG. 7C is a cross-sectional elevation view of the armature, taken along line 7C—7C of FIG. 7A;

FIG. 8A is a top plan view of a microphone used in the hearing aid device of FIG. 1A;

FIG. 8B is a cross-sectional elevation view of the microphone of FIG. 8A;

FIG. 8C is an enlargement of the upper right hand corner portion of FIG. 8B;

FIG. 9A is a top plan view of an alternative microphone for the hearing aid device of FIG. 1A;

FIG. 9B is a cross-sectional elevation view of the microphone of FIG. 9A;

FIG. 9C is an enlargement of the upper right hand corner portion of FIG. 9B;

DETAILED DESCRIPTION OF THE PREFERRED EMBODIMENT

Figure 1A:
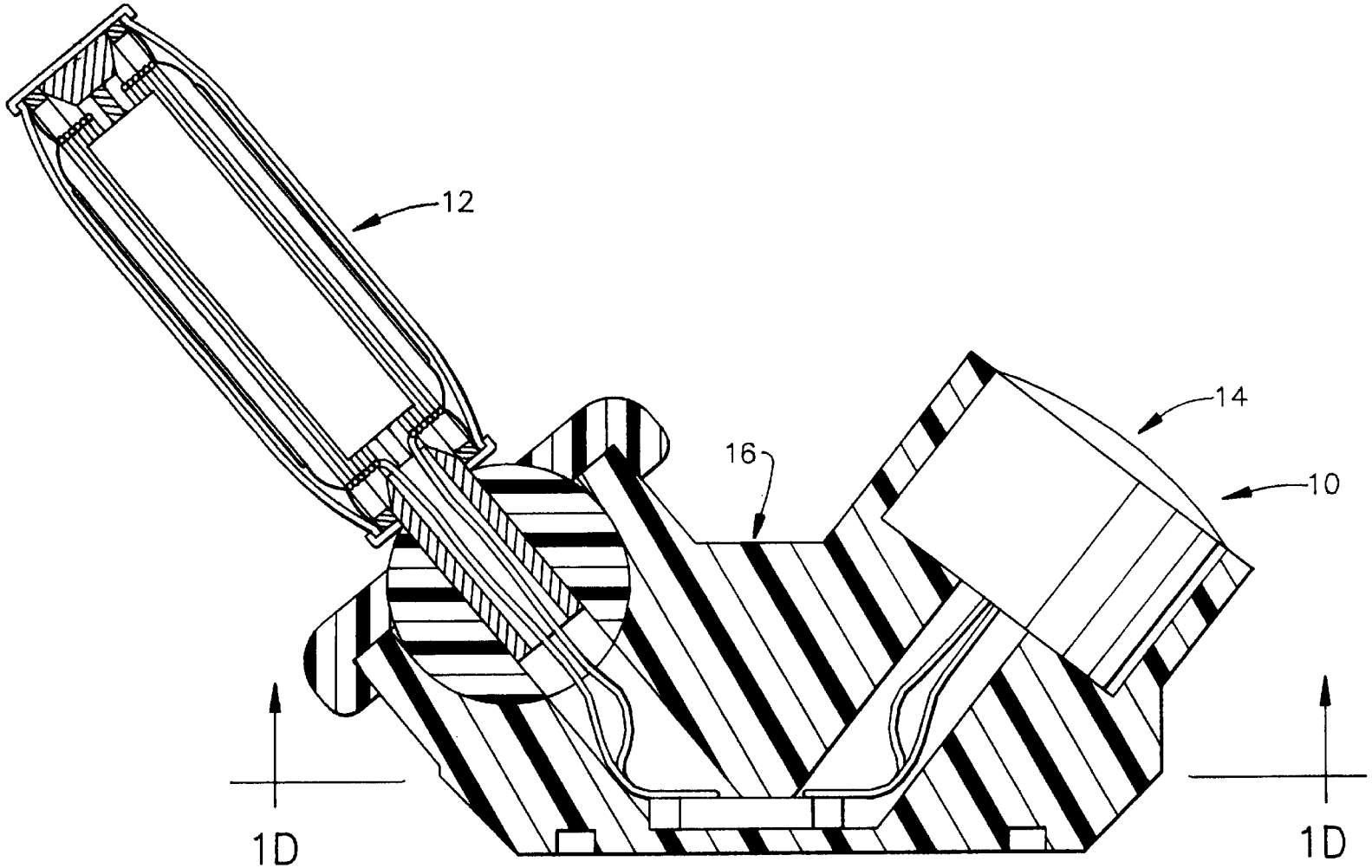
FIGS. 1A–1E show several views of the complete hearing aid device constructed in accordance with the principles of the present invention.
Figure 1B:
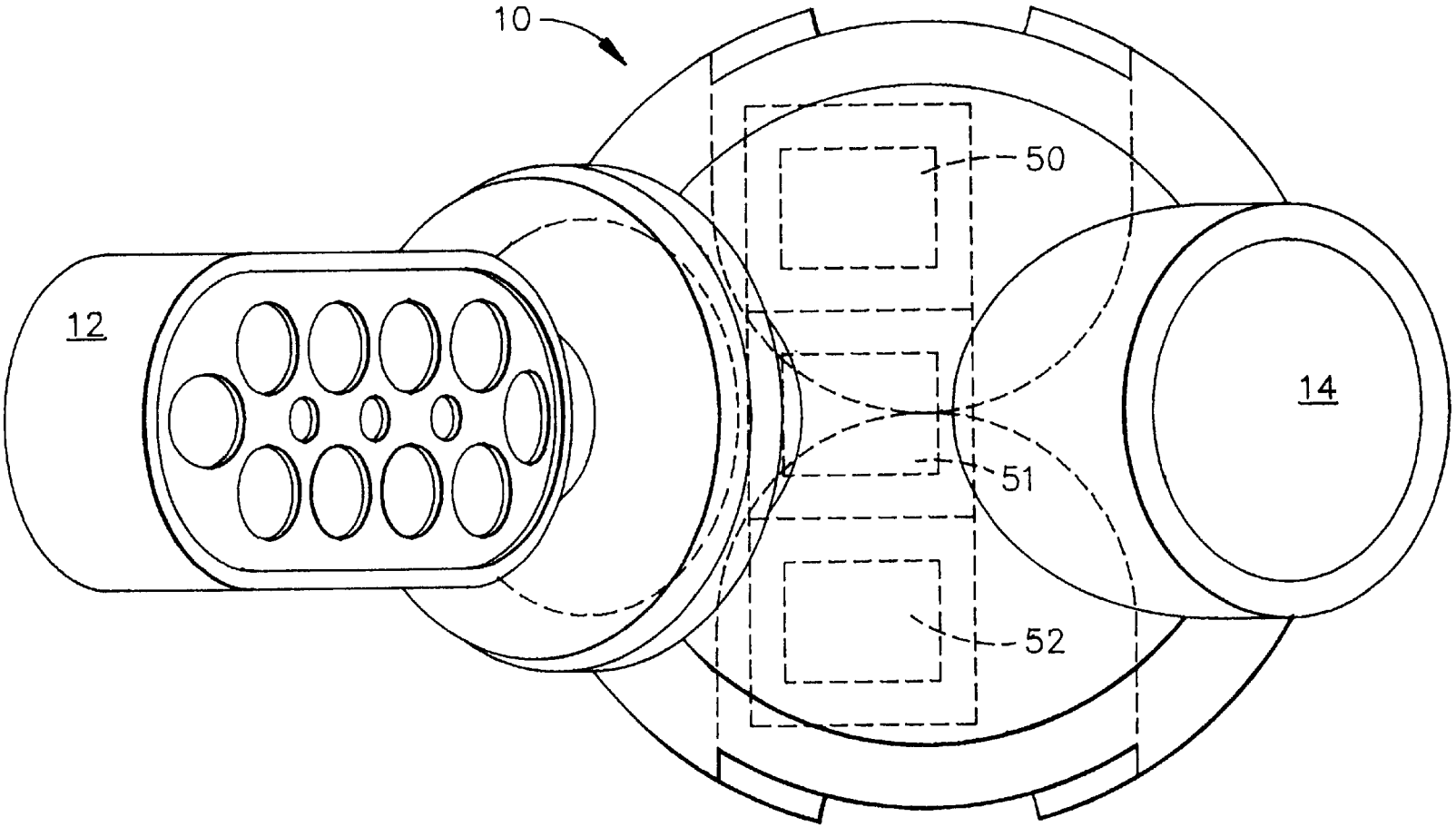

Referring now to the drawings, a preferred embodiment of the hearing aid device 10 is shown, containing a speaker portion 12, a microphone portion 14, and a main body portion 16. Several views of these portions of the hearing aid device 10 are illustrated in FIGS. 1A–1E. FIG. 1B shows a preferred location for the electronic components of the device 10. An integrated circuit which makes up an accelerometer is illustrated shown as an electronic chip 50. An integrated circuit which contains the amplifiers and any transmitter and receiver components is illustrated as an electronic chip 52. A third electronic chip 51 for a third integrated circuit is disposed between chips 50 and 52, and can be used for additional transmitter components, as well as any desired supplemental signal processing circuitry. Electrical connections from the speaker and microphone portions 12 and 14 to the electronic components are preferably made at the connection of electronic chip 51.

Figure 1C:
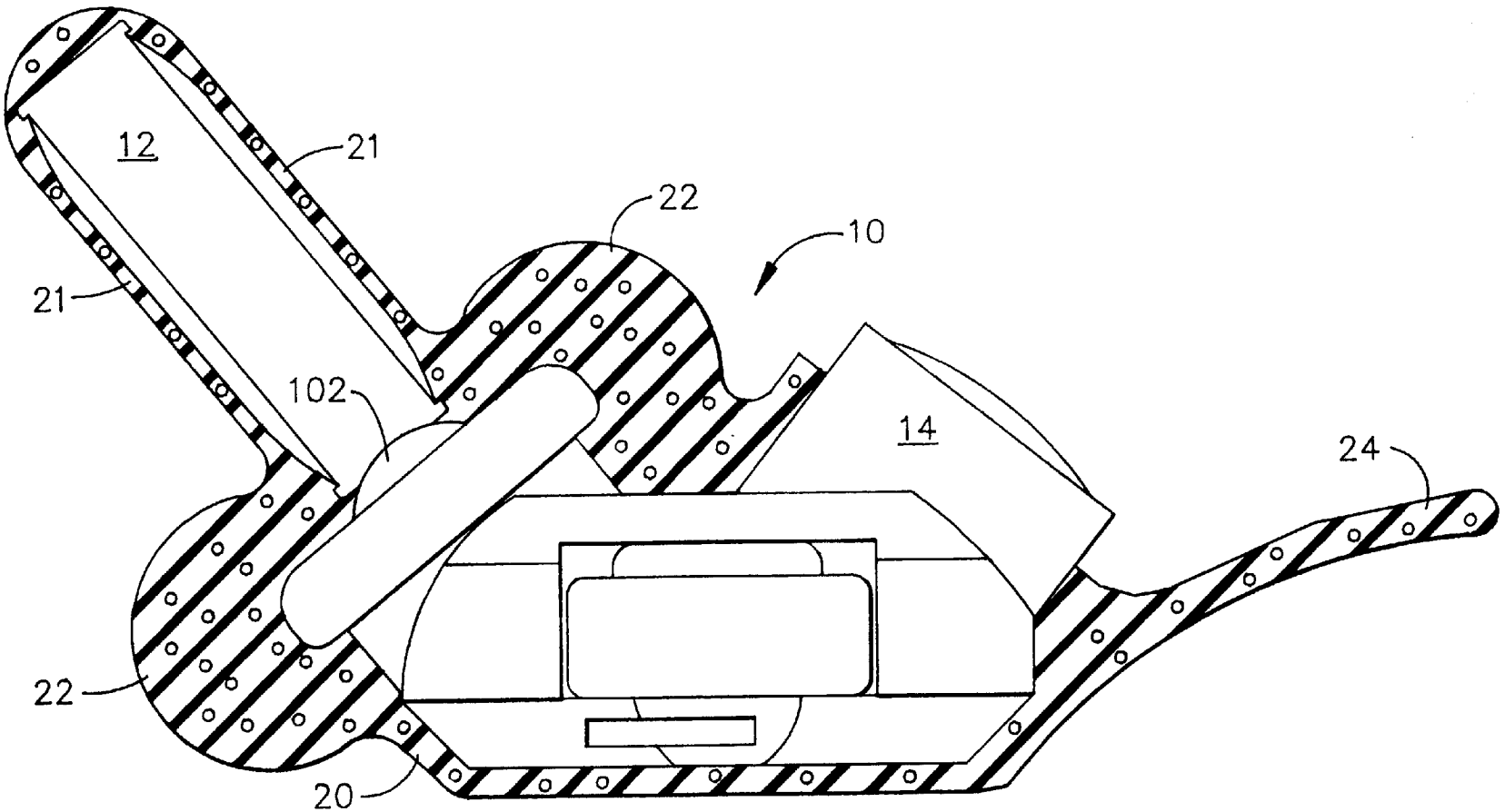

As illustrated in FIG. 1C, the hearing aid 10 is covered with a disposal boot 20, which is made of an open cell deformable foam material which has a memory. The portion 21 of the disposable boot 20 which fits over the speaker portion 12 is very thin, in the order of 1 mm, and is shown with an exaggerated thickness in FIG. 1C for purposes of illustration. One of the functions of the disposable boot 20 is to seal the air inside the external auditory canal so that it cannot escape nor can any atmospheric air enter that area, once the hearing aid 10 is in place. This is accomplished by increasing the thickness of the boot 20 in the portion 22 surrounding the articulated joint 102. Another function of the disposable boot 20 is to prevent contamination of the hearing aid by acting as a shield against eye wax, (cerumen) and other exfoliants of the epithelium of the ear canal. Another feature of the disposable boot 20 is a pull-off tab 24 which allows the user to grip that portion of the disposable boot and pull the entire hearing aid out from the user's ear.

Figure 1D:
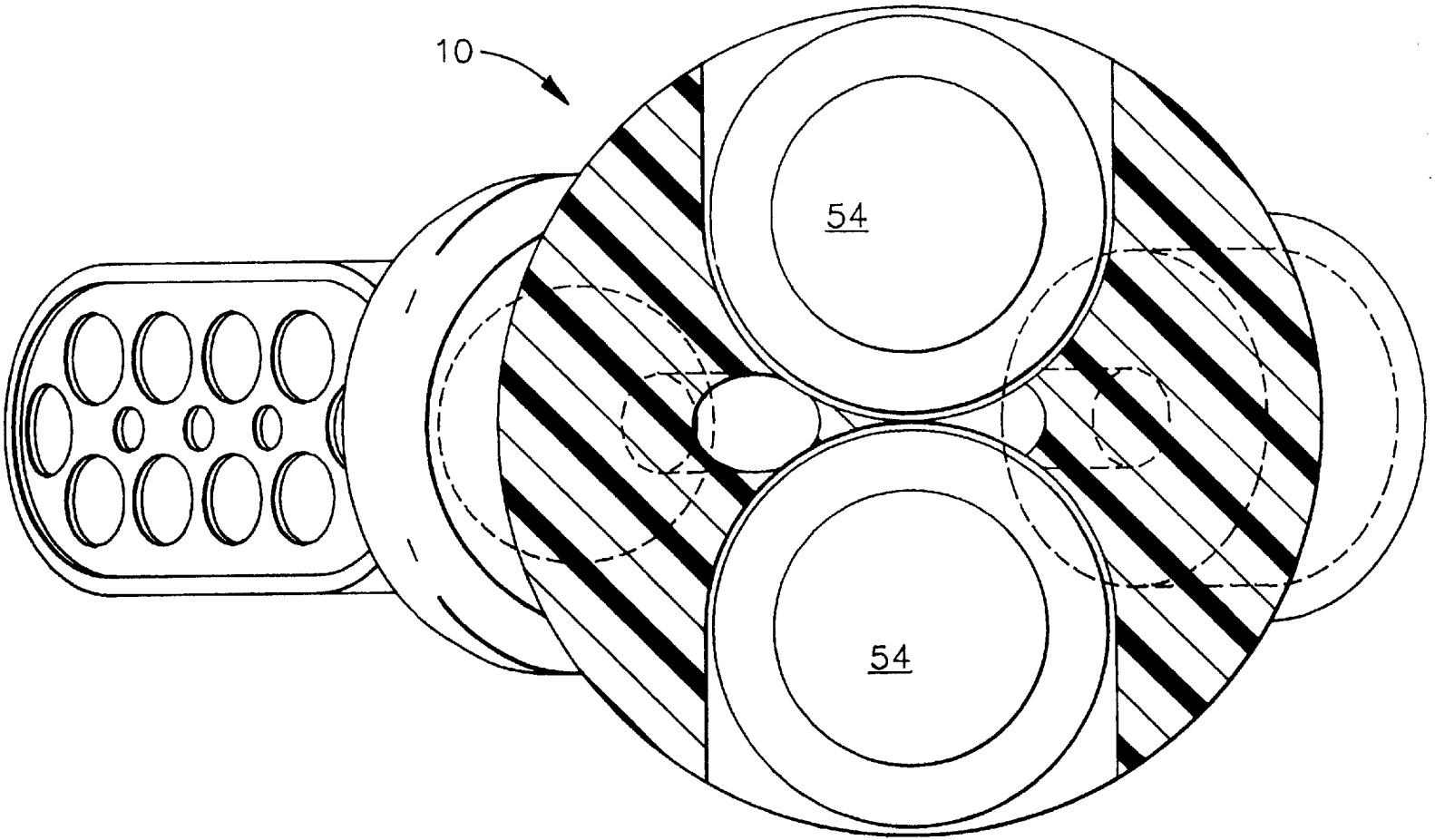

As most clearly shown in FIG. 1D, the hearing aid device 10 uses a power source, which in the preferred embodiment comprises two batteries 54. The batteries 54 of the preferred embodiment are of the type 377 and are not connected in series, but are instead used to provide a bipolar DC power source for the electronics of the hearing aid. It is obvious that other DC power sources could be used in lieu of the batteries 54.

Figure 1E:
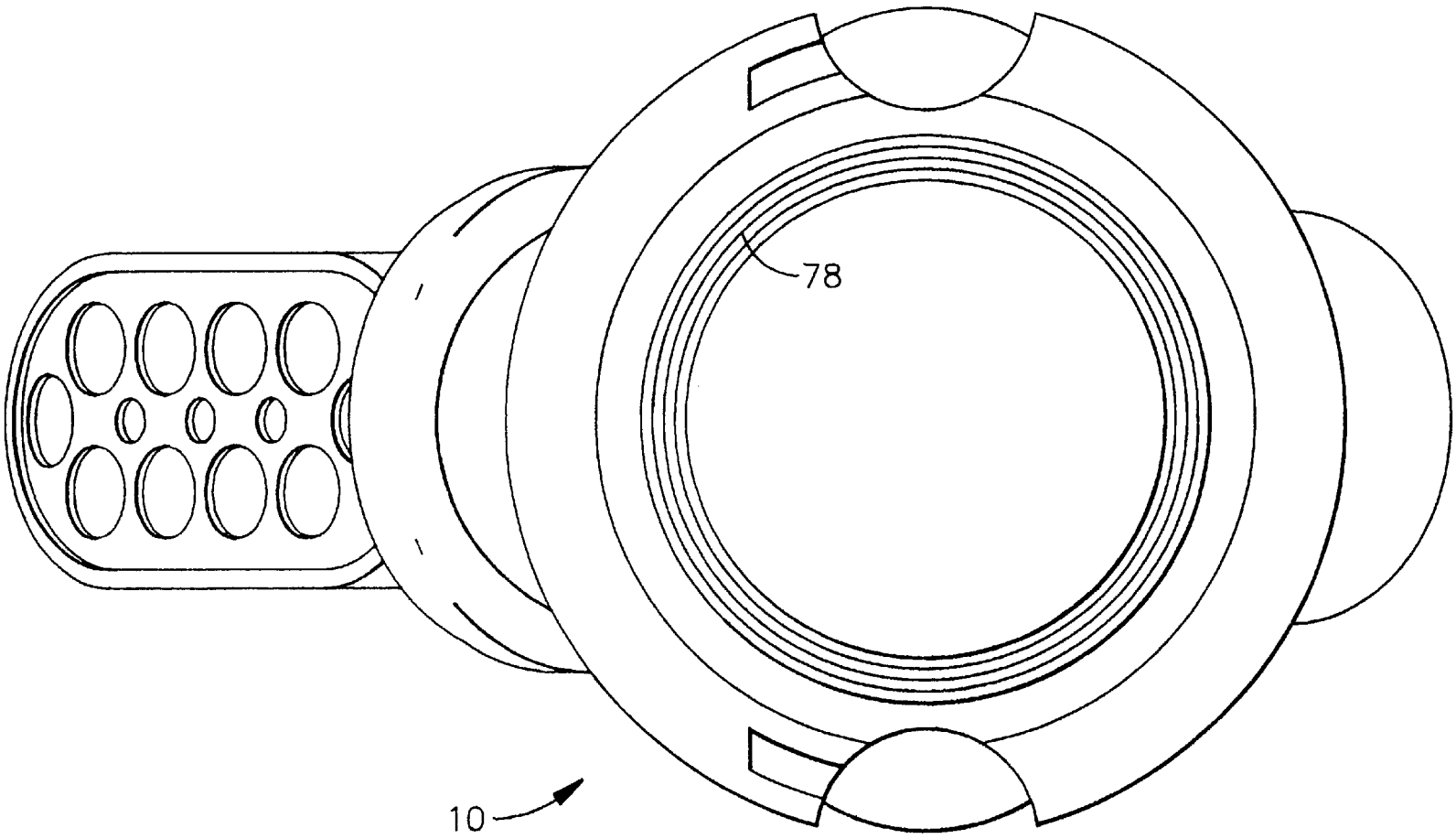
Figure 2:
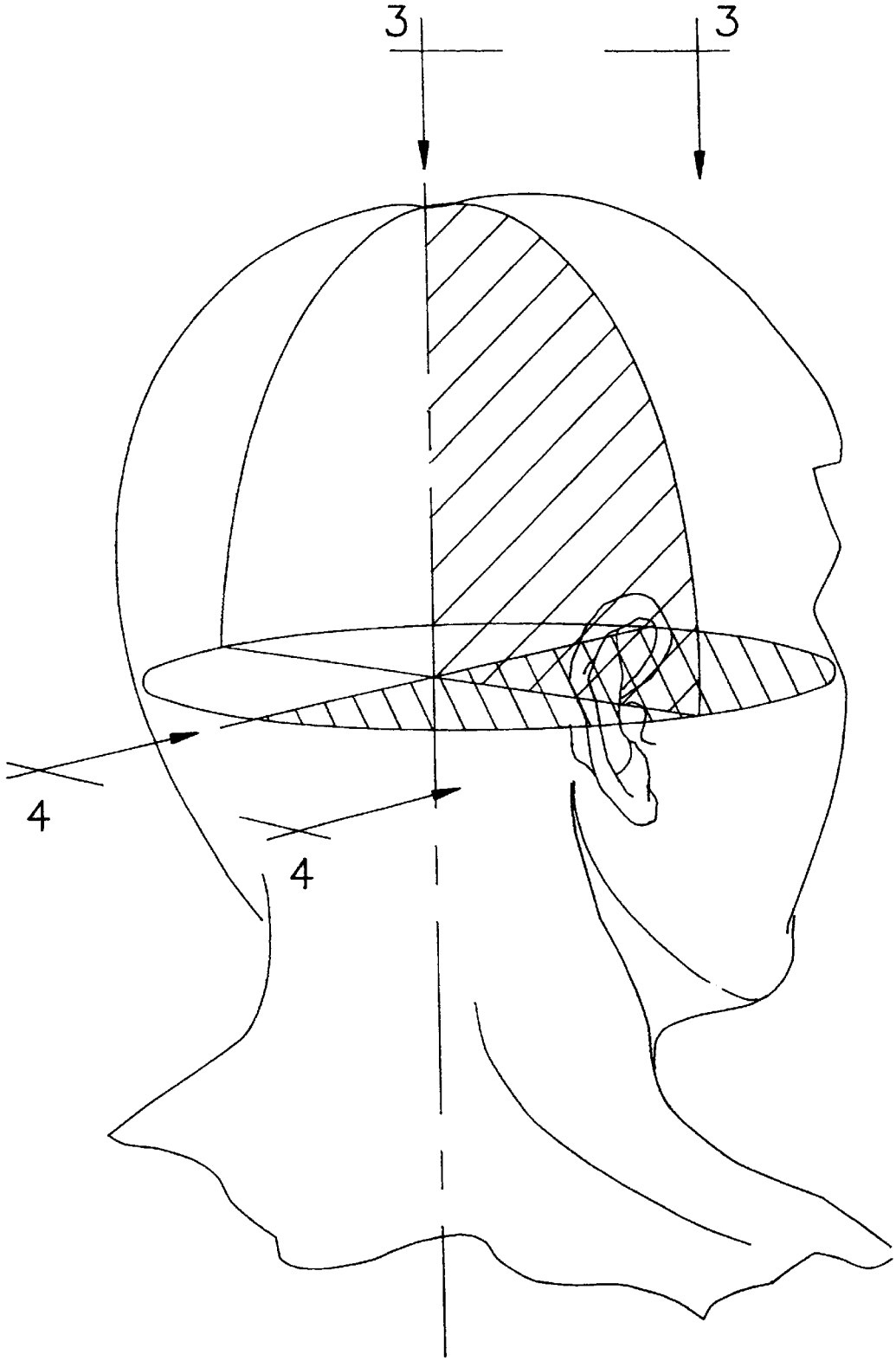
FIG. 2 is an oblique view of a human head, showing the anatomical sections designated as the coronal section, and the transverse section.

A detail of the loop antenna 78 is illustrated in FIG. 1E. Such loop antenna 78 could be used for any radio frequency transmitter or receiver devices that might be used in conjunction with the hearing aid 10.

Figure 3A:
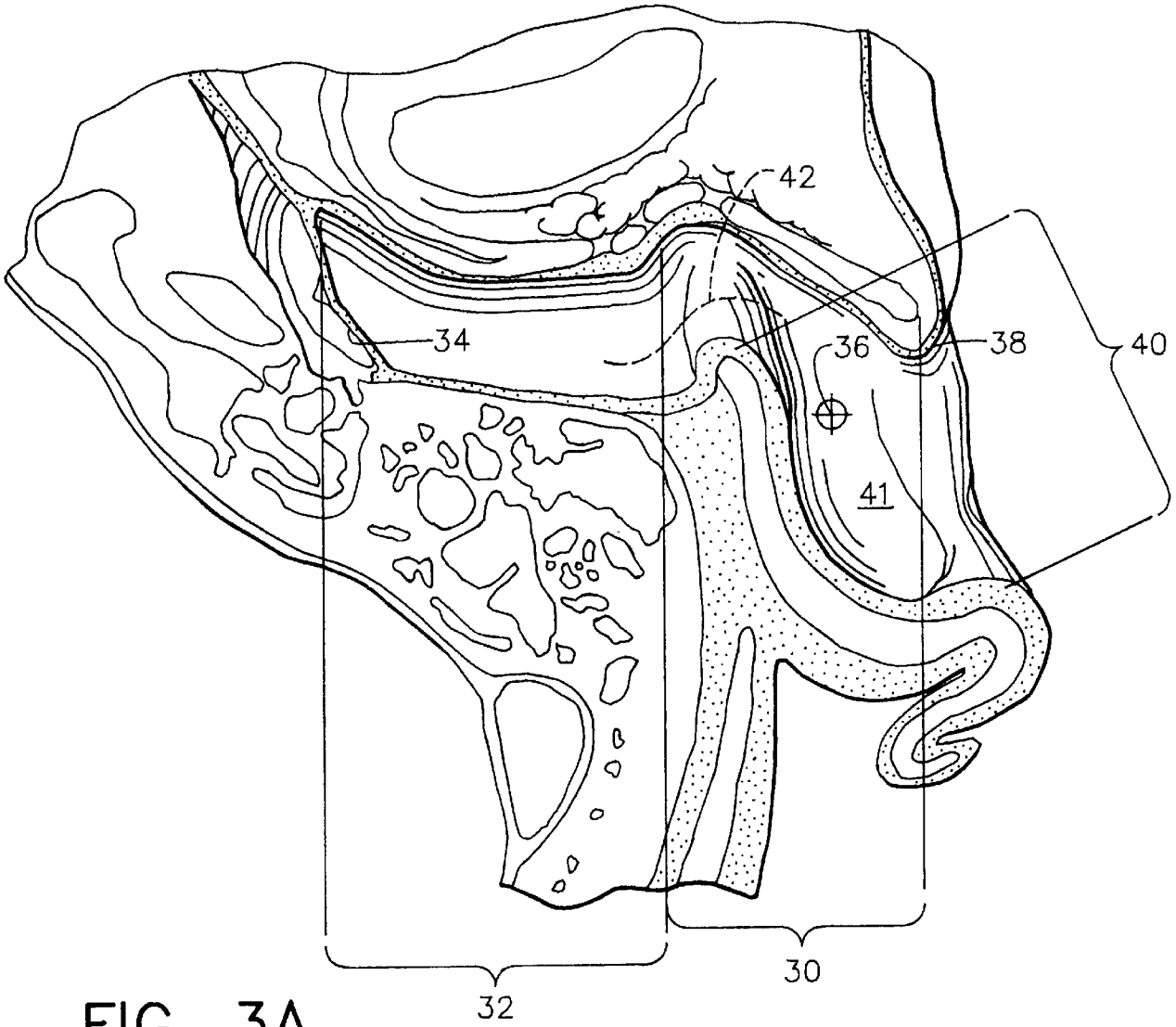
FIG. 3A shows the correct anatomical view of the transverse section of the human ear, taken along line 3—3 in FIG. 2.

In order to understand the significance of several aspects of this invention, it is necessary to fully appreciate the precise anatomy of the human ear. FIG. 3A is an anatomically accurate, transverse section of the human ear showing the important structural details relevant to the present invention. Starting at the exterior point of the ear, the curved surface of the concha 41 is illustrated in the region bounded by the bracketed lines 40 in the illustration of FIG. 3A. The acoustic focus of the concha 41 is located at the point identified by the numeral 36. The point 36 is the location where the natural shape of the human ear focuses incoming sound waves. The external auditory canal is formed by two distinct portions. The outer most portion of the external auditory canal, called the cartilaginous part of the external auditory canal, is the portion enumerated 30 between the two bracketed lines. The innermost portion of the external auditory canal is called the bony part of the external auditory canal 32, and lies between the innermost two bracketed lines. The tragus 38 lies at the entrance to the external auditory canal opposite the concha 41. The sigmoid portion of the cartilaginous part of the external auditory canal is the S-shaped dashed line identified by the numeral 42. The average inner diameter of the external auditory canal is approximately 7 mm. At the innermost portion of the external auditory canal lies the tympanic membrane 34, which is also called the eardrum. The effective surface area of the tympanic membrane lies in the range of 30–35 square mm.

Figure 4A:
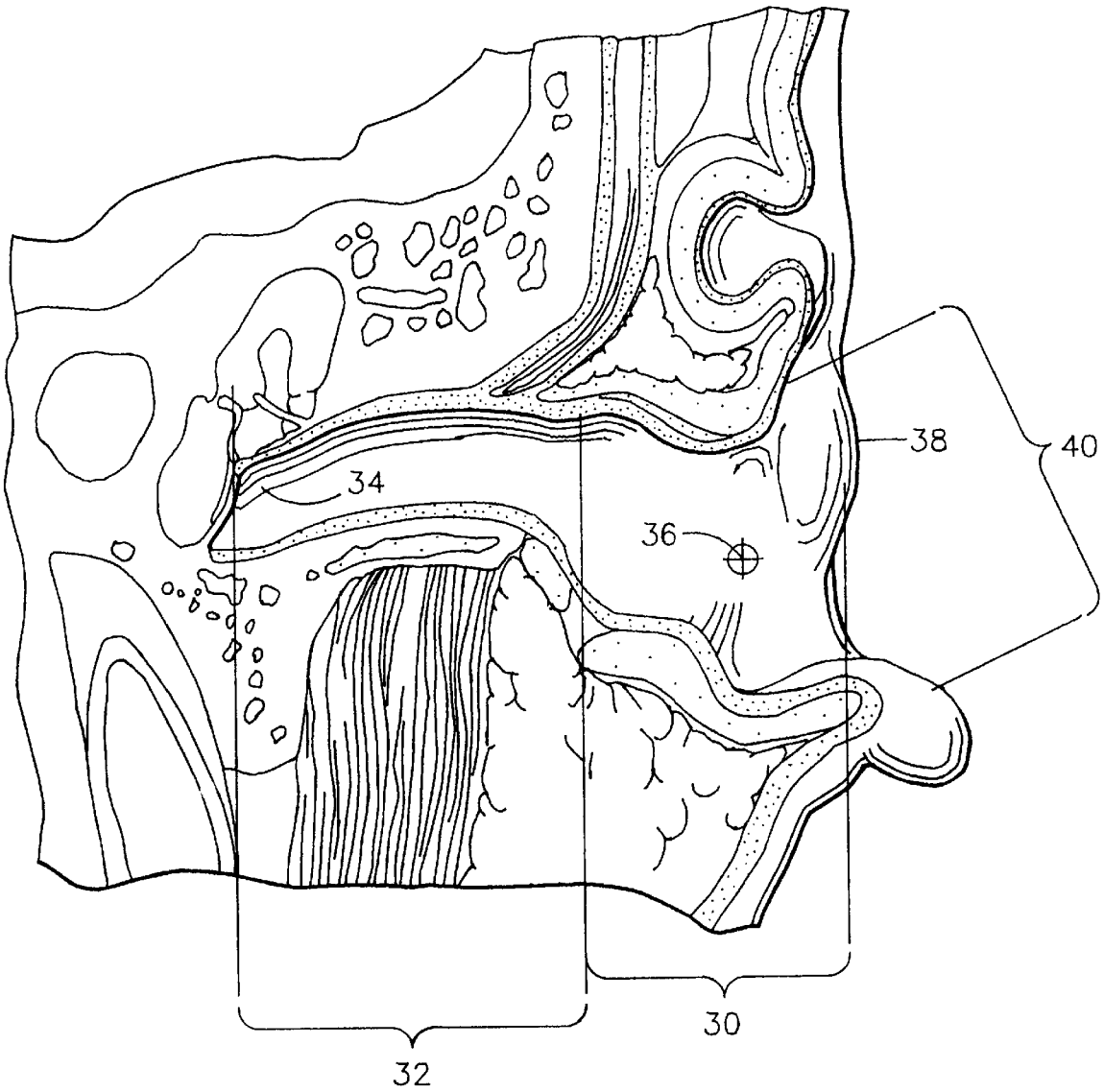
FIG. 4A shows the correct anatomical view of a coronal section of the human ear, taken along line 4—4 in FIG. 2.

The same anatomical features of the human ear are again accurately depicted in FIG. 4A, however, FIG. 4A is a coronal section of the human ear, which is 90° from the transverse section of FIG. 3A.

Figure 3B:
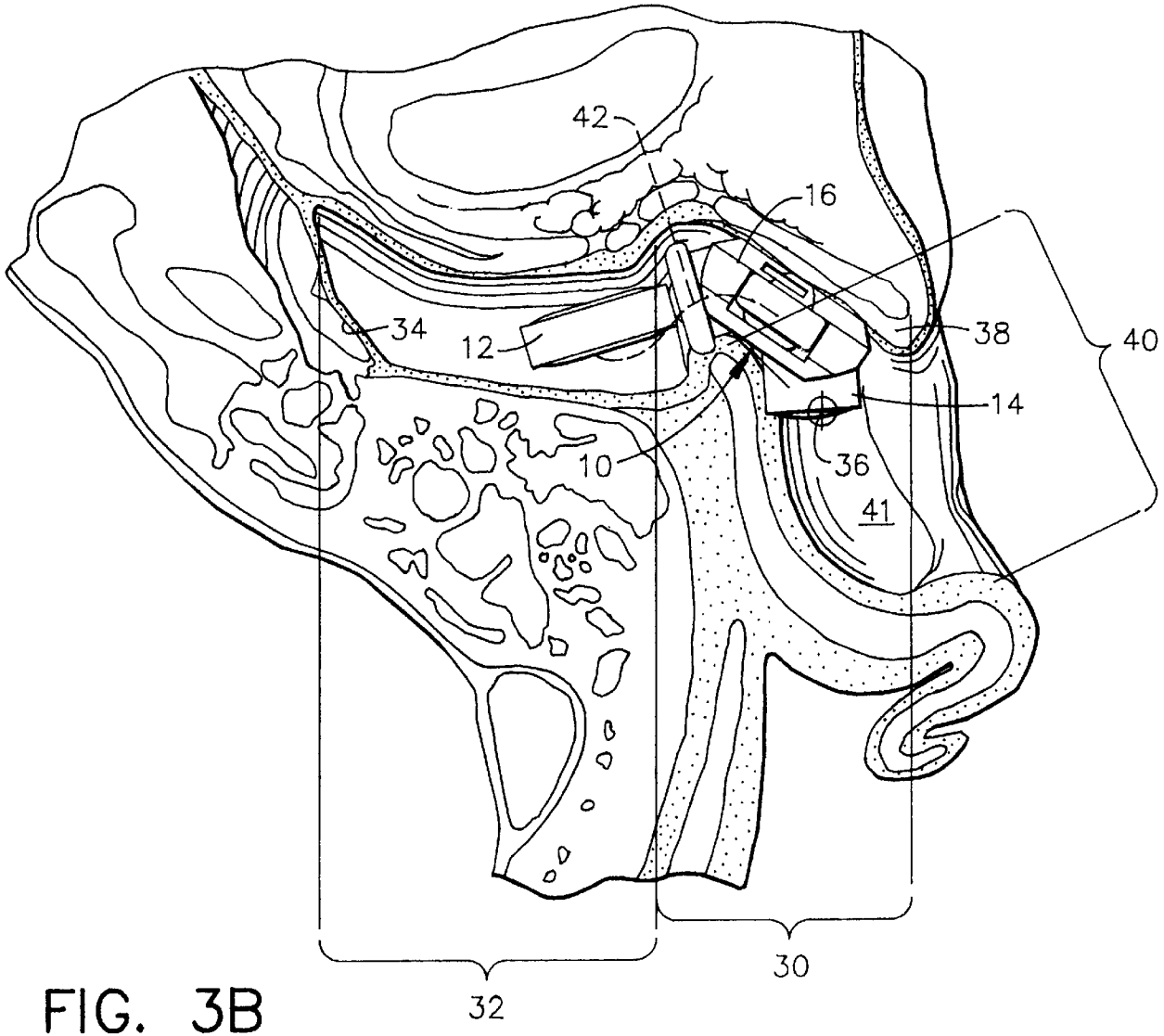
FIG. 3B shows the same view as FIG. 3A, however, it includes the placement of the hearing aid device.

FIG. 3B depicts the hearing aid device 10 positioned in the human ear. As can be seen in FIG. 3B, the main body portion 16 of the hearing aid 10 is located directly at the entrance of the external auditory canal. The main body position 16 lies in contact with, and is hidden from view by the tragus 38. The microphone portion 14 of the hearing aid 10 is advantageously located such that it is directly at the acoustic focus of the concha 36 so that it maximizes the natural sound gathering and direction locating anatomical features of the human ear. The speaker portion 12 of the hearing aid is located entirely inside the external auditory canal, and it fits past the sigmoid portion 42 of the cartilaginous part of the external auditory canal. Quite significantly, the speaker portion 12 is designed to fit entirely inside the external auditory canal, yet has a large enough surface area of active speaker element to effectively vibrate the human tympanic membrane 34.

Figure 4B:
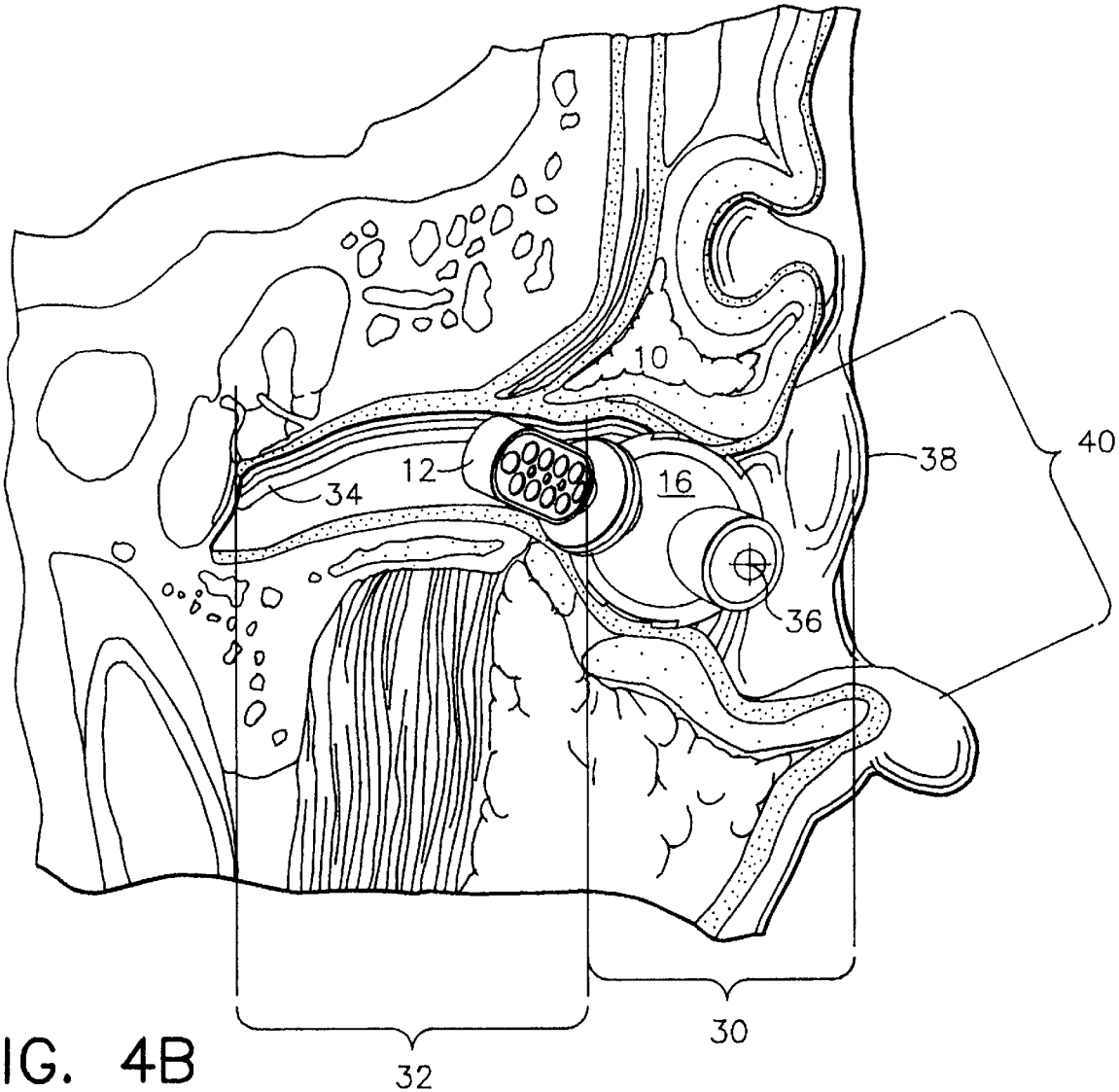
FIG. 4B shows the same view as FIG. 4A, however, it also includes the placement of the hearing aid device.

The same elements of the hearing aid device 10 are described in the companion view, FIG. 4B, which is a coronal section of the human ear. Again, the microphone portion 14 of the hearing aid is located at the acoustic focus of the concha 36, and the speaker portion 12, which is clearly shown in this view, is located entirely inside the external auditory canal well past the sigmoid portion.

Figure 5A:
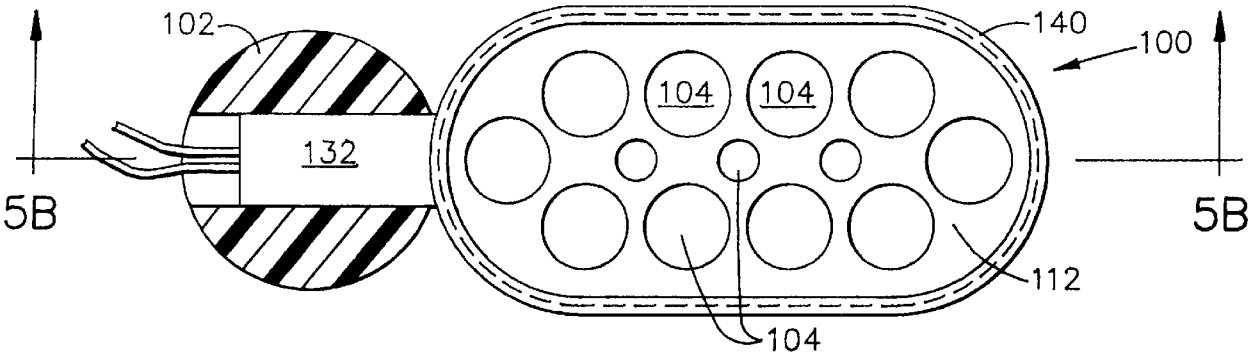
FIGS. 5A–5C show the details of the speaker portion of the hearing aid device of FIG. 1A.
Figure 5B:
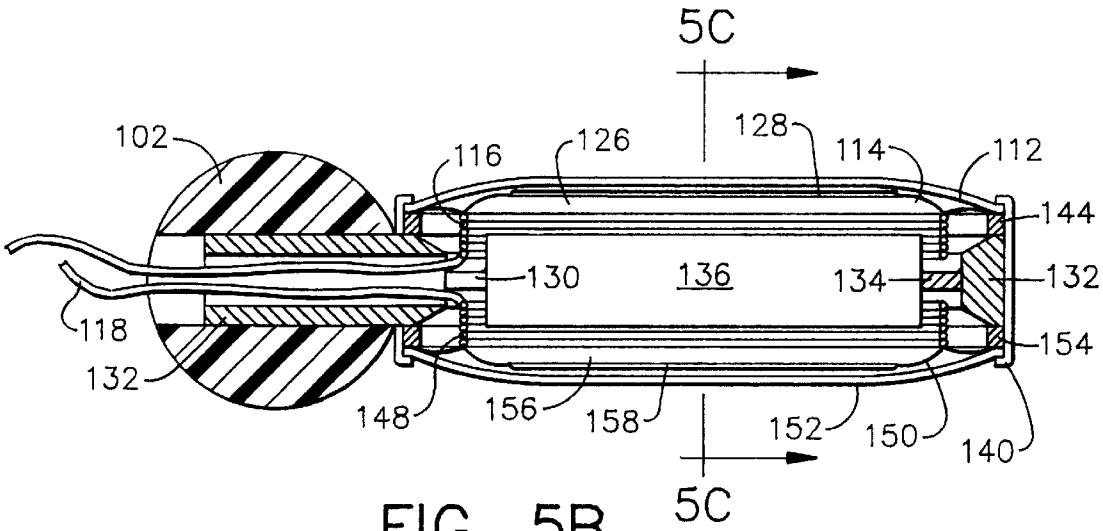
Figure 5C:
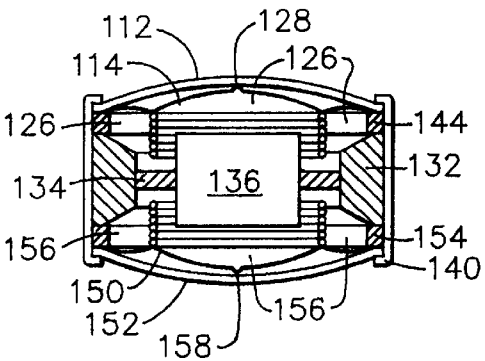
Figure 6A:
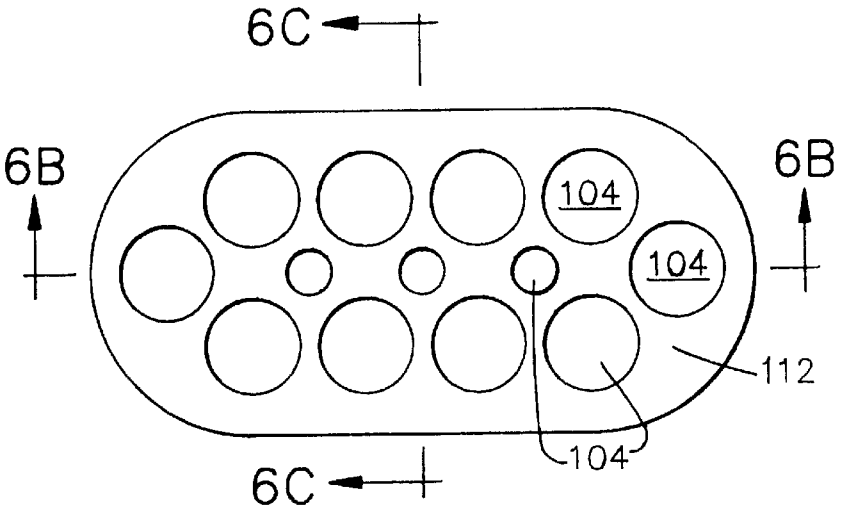
FIGS. 6A–6C show the details of the outer cover of the hearing aid device of FIG. 5A.
Figure 6B:
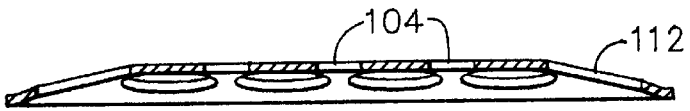
Figure 6C:
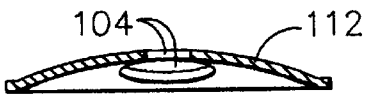

The speaker portion 12 of the hearing aid device 10 consists largely of a linear motor 100, which is described in detail in FIGS. 5A–5C. The top cover 112 of the linear motor 100 consists of magnetically permeable material. There are a number of air holes 104 of different sizes in the top cover 112. In the embodiment of FIG. 5B, there is also a bottom cover 152, also consisting of magnetically permeable material, and is constructed similarly to the top cover, also having air holes (not shown). The entire linear motor 100 is held together and surrounded by an outer housing 140. In the preferred embodiment of FIGS. 5A–5C, the outer housing 140 is made of shrinkable plastic material. The outer housing 140 is pressed around the outer pole piece 132, which is also called a banjo housing. The outer pole piece 132 is made of magnetically permeable material; in the preferred embodiment it is made of soft steel. The outer pole piece 132 extends through the ball of the articulated joint 102, and is hollow in that region, acting as a conduit for the electrical conductors 118 that lead to the speaker coils 116 and 148. The articulated joint 102 allows the speaker portion 12 to pivotally move in relation to the main body portion 16, which allows the speaker portion 12 to easily fit in the external auditory canal.

Figure 7A:
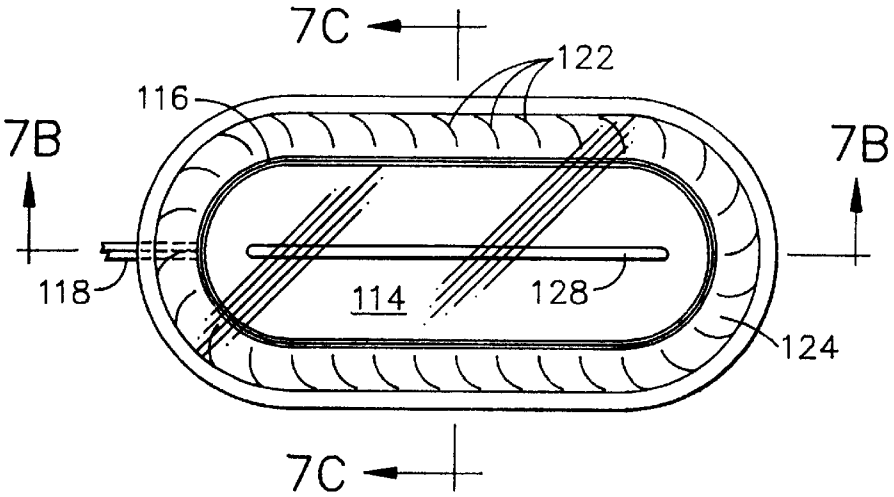
FIGS. 7A–7C show the details of the armature of the hearing aid device of FIG. 5A.
Figure 7B:
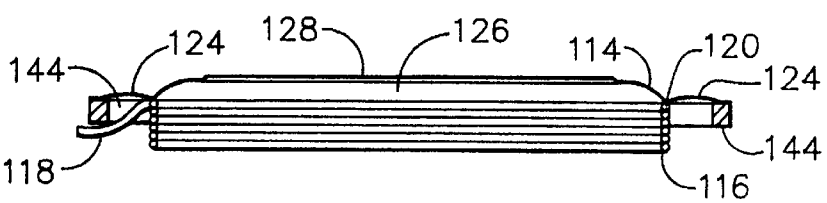
Figure 7C:
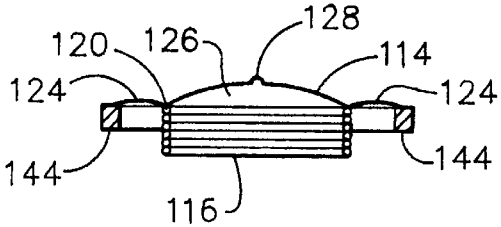
Figure 8A:
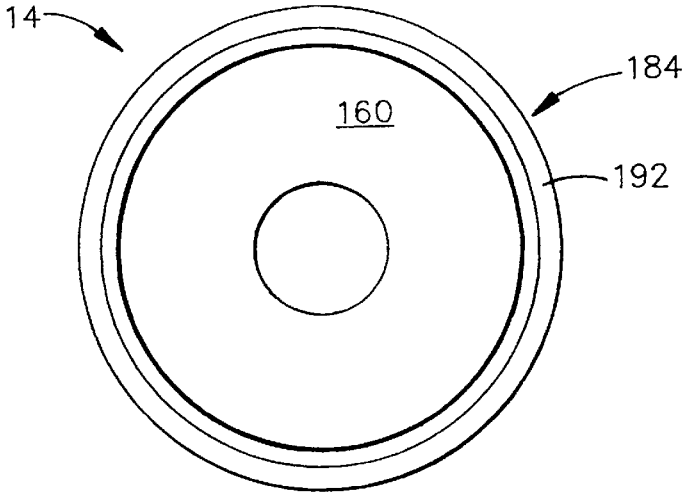
FIGS. 8A–8C show details of the microphone using an electret device.
Figure 8C:
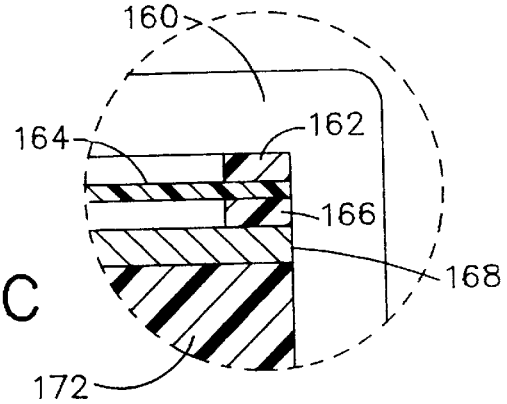
Figure 8B:
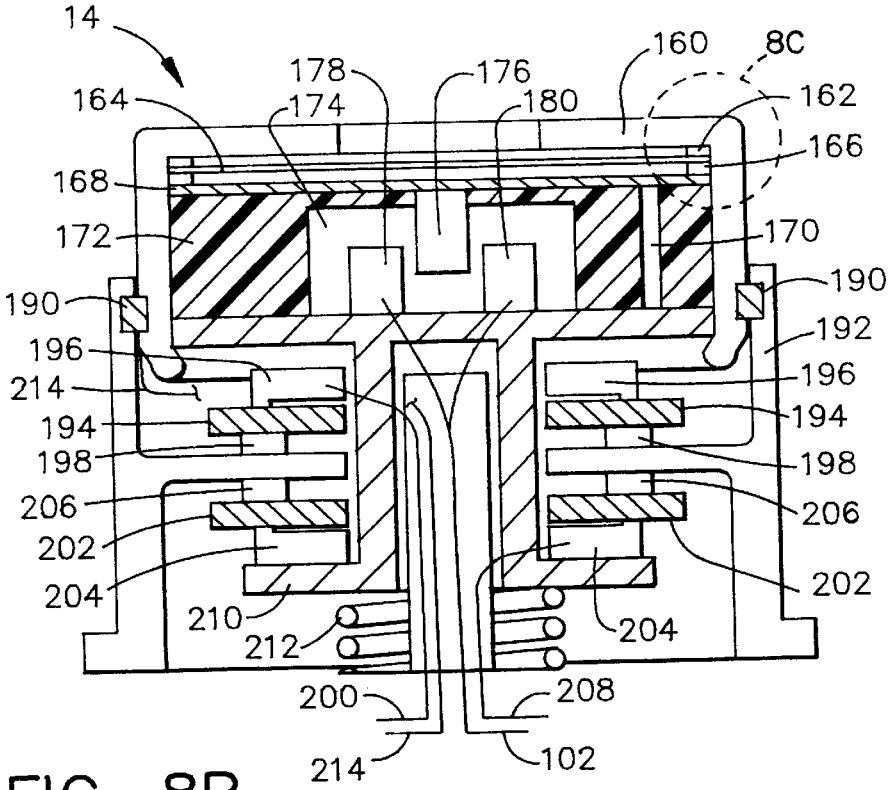

The top speaker membrane 114 consists of a three micron polyester film having a surface area at least equal to the effective surface area of the tympanic membrane, i.e., approximately 32 square mm in the preferred embodiment. The elongated oval shape and construction of the top speaker membrane 114 is also disclosed in FIGS. 7A–7C. The top coil 116 is rigidly affixed to the top speaker membrane 114 at attachment edges 120. To make the speaker more effective, compliance enhancing ripples 124 are formed in the top speaker membrane 114. An additional feature to make the speaker more effective is the curved pleats 122 in the material of the top speaker membrane. These pleats 122 are formed by serrating the mold for the top speaker membranes, and they enhance further the compliance of the top speaker membrane 114. The top speaker coil 116 consists of 15 turns of oval shaped windings, and is constructed of Number 48 AWG coated copper magnet wire. The coating consists of a polymeric insulation material and a secondary rubberized plastic shape-holding material. The top spacer ring 144 holds the very outer edges of the top speaker membrane 114 in place, and consists of metallic material such as brass. The top armature of the linear motor includes the top speaker membrane 114, the top coil 116, and the top spacer ring 144.

The bottom speaker armature consists of the same types of components and materials as does the top speaker armature. In the case of the bottom armature, there is a bottom speaker membrane 150, a bottom coil 148, and a bottom spacer ring 154. The materials of the bottom armature are virtually the same as that of the top armature, however, certain features may be varied to achieve a tweeter-type speaker on the top (having enhanced treble response), for example, and a woofer-type speaker on the bottom (having enhanced bass response). Such features that could be varied are those that affect the mass, spring and damping characteristics of the armature, such as the thickness of the speaker membranes, the number of windings of the coil, and the size of the magnet wire which makes up the coil, and also the size and shape of the resonance cavities. The top speaker resonance cavity is identified by the numeral 126, and the bottom speaker has a similar resonance cavity identified by numeral 156, which is larger in size (volume) for enhanced bass response in the illustrated embodiment. The control gap 130 can be used to vary-the amount of air that can be exchanged between two resonance cavities 126 and 156.

The linear motor 100 additionally consists of a permanent magnet 136, and a magnet support piece 134. The permanent magnet of the preferred embodiment consists of Neodimium-Boron-Iron, or Samarium Cobalt. Neodimium-Boron-Iron can exert a stronger magnetic field than Samarium-Cobalt, however, Samarium-Cobalt will not rust.

The attachment edges 120 are node points for the attachment of the coils to the speaker membranes. This attachment is made by a rubber-based glue. The speaker of the preferred embodiment, as described above, is a moving coil circuit, whereas prior art small hearing aid speakers generally have used variable reluctance circuits, which generally have given poor low frequency performance.

The microphone portion of the hearing aid 10 is detailed in FIGS. 8A–8C and 9A–9C. The embodiment illustrated in FIGS. 8A–8C uses an electret type microphone. Forming an outer housing for the microphone is the microphone cover 160. This cover can be made of formed metal, such as aluminum, or formed plastic. Just inside this cover is a first spacer 162, which consists of a material which is electrically nonconductive. This spacer is used to maintain a gap between the microphone cover 160 and the microphone diaphragm 164. The microphone diaphragm consists of a permanently charged material, such as metallized film or metallized polyester. On the other side of the microphone diaphragm 164 is a second spacer 166 which consists of a material which is electrically nonconductive. The second spacer 166 maintains the quiescent gap between the microphone diaphragm 164 and the plate 168.

The plate 168 consists of conductive metal, such as nickel plated copper, or steel. The plate 168 rests on top of the mounting block 172, and also is attached to the gate 176 of a field effect transistor 174. The mounting block 172 is formed of electrically nonconductive material such as plastic. The mounting block contains a provision 170 for venting the gap which is inside the second spacer 166 and is between the microphone diagram 164 and the plate 168. The field effect transistor 174 also has a source 178 and a drain 180, and with a pair of wires 182 attached, one to the gate and one to the source. Such electret microphone assemblies 184 are available in the prior art, such as one made by Panasonic having a part number WM-6A.

The microphone portion 14 illustrated in FIG. 8 also consists of two potentiometers and the on/off switch. The on/off switch consist of a conductive ring 190 which has a gap for the off portion of the ring. The turning of the microphone cover 160 actuates this on/off switch. The treble-bass filter control consists of a first potentiometer. The first potentiometer has a ring of resistance film media 194, which is not necessarily uniform, and a rotatable wiper 196. The first potentiometer media 194 is physically located and held in place by a nonconductive support 198. The rotatable wiper 196 is only engaged to rotate when the actuator 210 is depressed while being rotated. The actuator 210 is forced down when the microphone cover 160 is depressed. The support structure 192 is the overall housing base for maintaining the potentiometers in place while the microphone cover 160 is being depressed.

A second potentiometer controls the volume of the hearing aid. This second potentiometer consist of a ring of resistance film media 202, a rotatable wiper 204, and physical support which consists of a nonconductive support 206. The second potentiometer operates in the opposite sense as the first potentiometer in that its rotatable wiper 204 is actuated when the actuator 110 is not depressed. When the actuator 210 is not depressed, the spring 212 keeps tension on the rotatable wiper 204, and allows it to be rotated. To effectively communicate electrical information to the control means, the potentiometers and the on/off control must have conducting means such as wires attached to them. A pair of wires 200 runs to the first potentiometer, a second pair of wires 208 runs to the second potentiometer, and a third pair of wires 214 runs to the on/off ring.

Figure 9A:
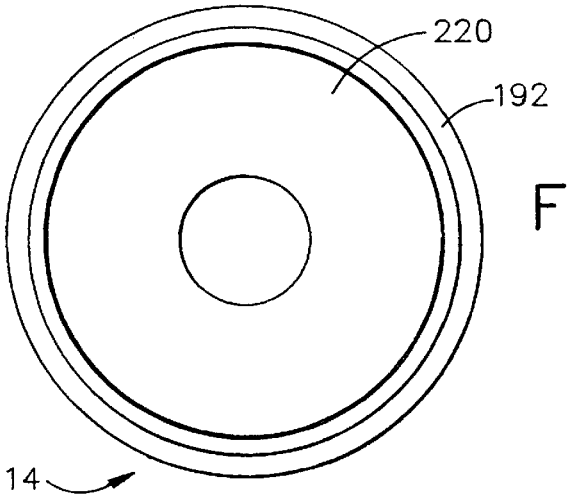
FIGS. 9A–9C show an alternative microphone using a piezo electric device.
Figure 9C:
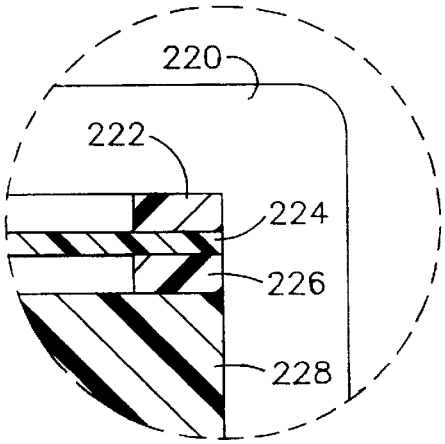
Figure 9B:
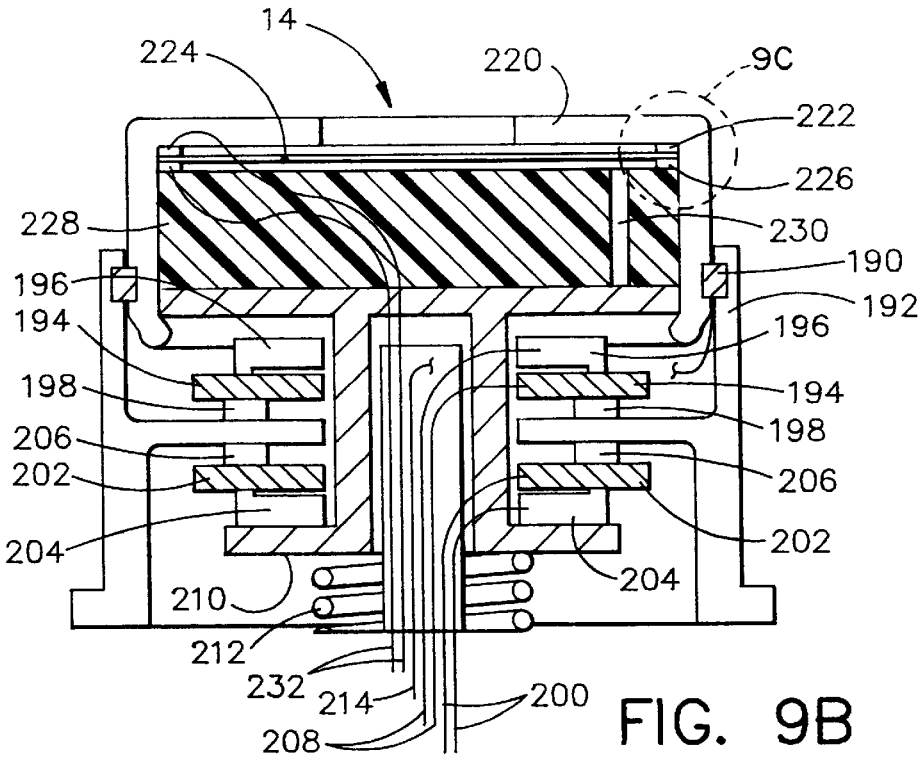

A piezo type microphone can alternatively be used rather than the electret type microphone. In the embodiment of FIG. 9, the microphone cover 220 is approximately the same size as the electret microphone cover 160. In this case, the microphone cover 220 must be made out of a material which is electrically nonconductive. Just beneath the microphone cover 220 is the first spacer 222. This first spacer consists of an electrically conductive material, and is connected by a wire to the positive input of the microphone transducer amplifier. Below (on the other side of) the first spacer 222 is the microphone diagram 224. This diagram consists of a material called Kynar, which is made by Pennwalt Corporation. On the other side of the microphone diagram 224 is a second spacer 226. This second spacer is also made of an electrically conductive material, and is connected to the negative input of the transistor amplifier. The two spacers 222 and 226 plus the microphone diagram 224 rest on the mounting block 228, and have two wires 232 attached to the two spacers (one wire per spacer). In the embodiment of FIG.9, there is no field effect transistor and there is no plate. The remaining parts of the microphone portion of the embodiment of FIG. 9B are precisely the same as that shown in FIG. 8B.

Figure 10A:
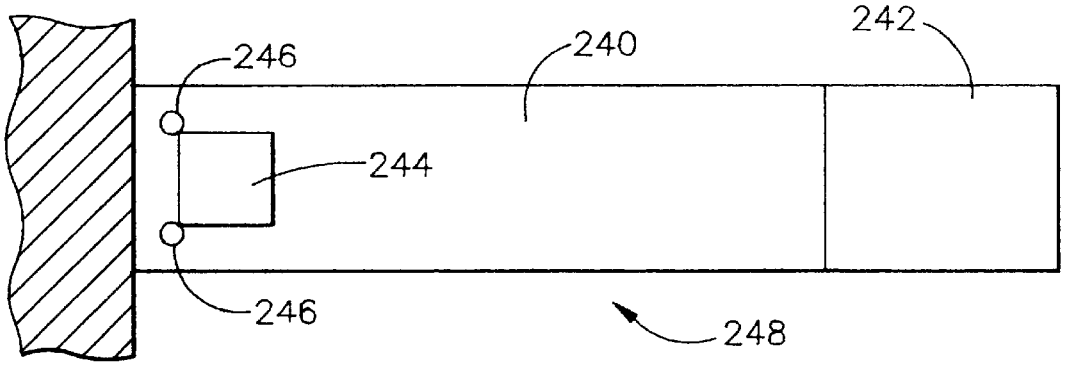
FIG. 10 shows an accelerometer, used in the hearing aid device of FIG. 1A.
Figure 10B:
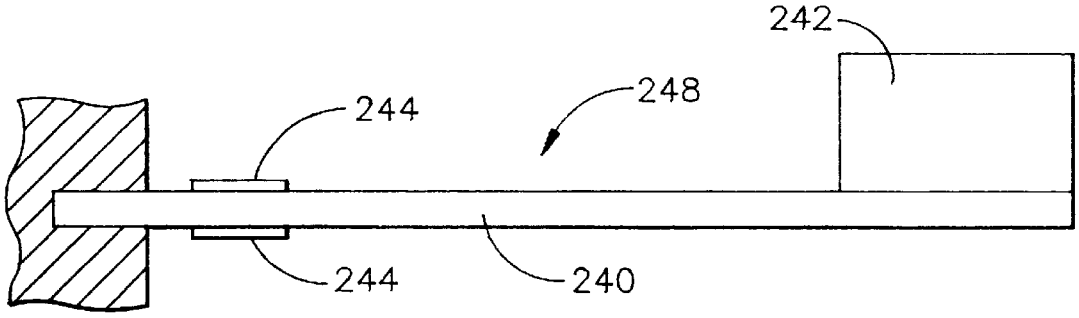

One embodiment of the hearing aid can consist of an optional accelerometer assembly 248. The accelerometer is used to either enhance or attenuate the conductive sound of the user's voice through the user's bones into the cochlea of the ear. These conductive sound waves travel through the temporal bone which completely surrounds the inner ear, and directly excite the mechnoneural sensory structures within the inner ear. Conductive sound is present in the normal ear, and its magnitude is normally balanced with the air-borne portion of one's own voice. However, such conductive sound, if existing at a large magnitude, can be very distracting to the user, in which case the accelerometer signal would be attenuated. If it is absent in yet other users it causes a distorted perception- of the user's own voice, and in which case the accelerometer signal would be amplified. The accelerometer assembly 248 is built on the integrated circuit 50 in the main body portion 16 of the device. The general layout of the accelerometer is given in FIGS. 10A–10B, which shows the substrate 240 and the seismic mass 242. The substrate can be made of silicon, as used in the substrate for integrated circuits. The seismic mass 242 would consist of a high density material, such as copper. Sensing elements 244 are laid out on the substrate 240 and consist of materials having electrical characteristics which are sensitive to strain. The nodes 246 are enlarged pads so as to more easily make electrical connection to the accelerometer assembly 248. The entire accelerometer assembly 248 is built onto the integrated circuit 50, and is physically isolated from the microphone and the speaker. The accelerometer is, therefore, not sensitive to air-borne sound waves, but only bone-conducted sound waves.

It is obvious to one skilled in the art that the accelerometer need not consist of a seismic mass 242 mounted on a strain gauged beam (substrate 240) as described above. Other types of accelerometers having similar size and construction could be used in the alternative. Such other types of accelerometers could consist of a mass 242 mounted on the movable portion of a charged membrane 240, or a mass 242 mounted on a piezoelectric beam 240 (called a piezo bimorphic). The major difference between the different types of accelerometers is the material used for the beam (the substrate 240), the nature of the sensing elements 244 which are attached to the beam 240, and the signal conditioning electronics required among the various types.

Figure 11:
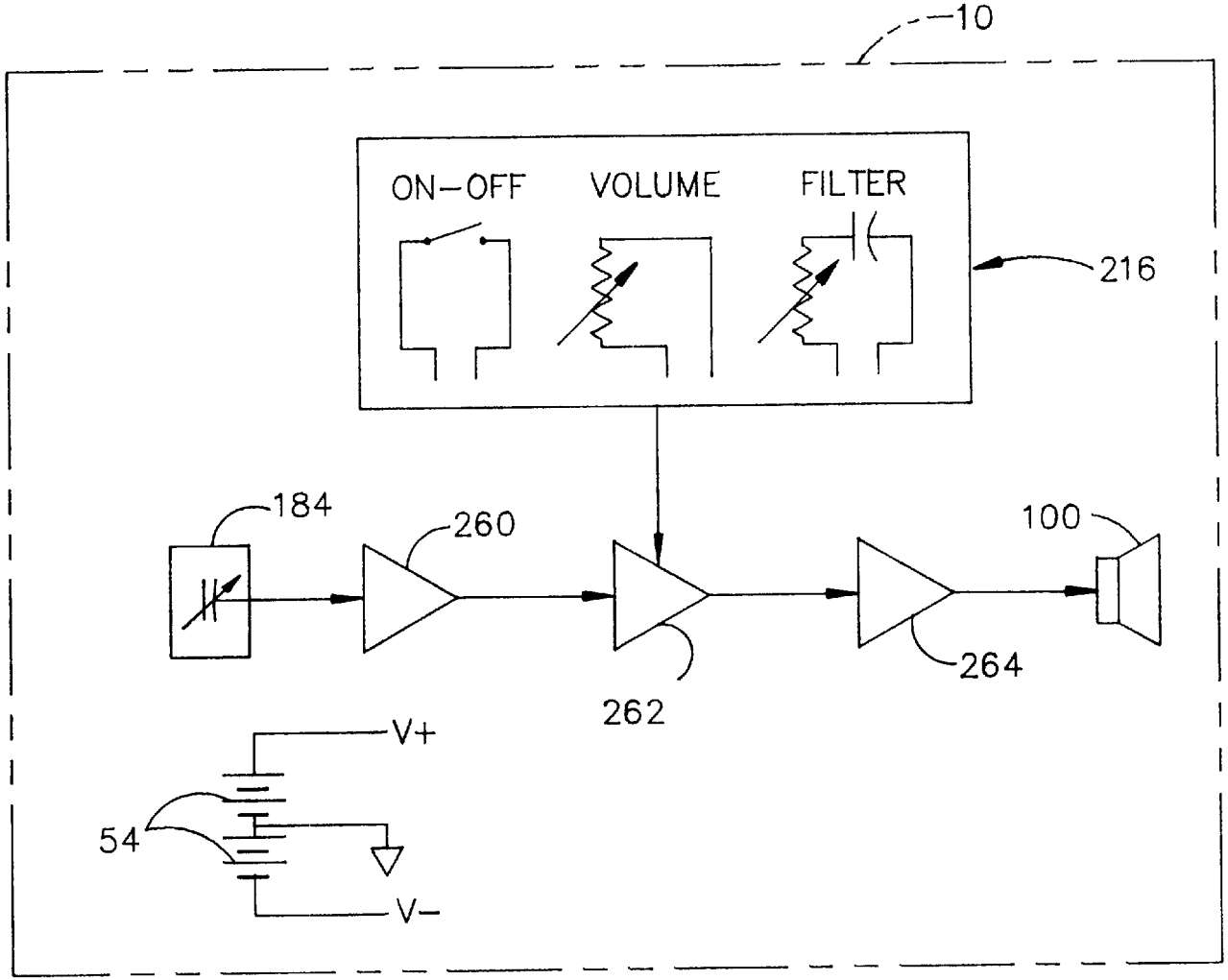
FIG. 11 is an electrical schematic of the hearing aid device of FIG. 1A having local controls.

The electrical schematic in block diagram form of a stand alone hearing aid 10 is given in FIG. 11. The control means 216 consists of three control devices which are a part of the microphone portion 14. The three controls included in control means 216 are the on/off switch, the volume control potentiometer, and the treble-bass filter potentiometer. FIG. 11 uses an electret microphone 184, however, it should be recognized that any type of miniature microphone could be used in this application. The sound energy is transformed by the microphone 184 into electrical signals which are passed into the input microphone transducer amplifier 260. After initial amplification, the electrical signal is then passed into a set of amplifiers which act as a treble-bass filter and an intermediate gain amplifier 262. This treble-bass filter and intermediate gain amplifier 262 communicates with the control means 216 so as to properly control the hearing aid as per the user's wishes. Any automatic gain control functions, whether linear or non-linear in profile, are performed by the intermediate gain amplifier 262. The output of the treble-bass filter and the intermediate gain amplifier 262 is then communicated to an output power amplifier 264. The power amplifier 264 has as its output stage a class B push-pull dual transistor output. By use of a dual DC voltage power supply (supplied by two DC batteries 54), all of the amplifiers in the hearing aid can run in a bipolar configuration, including the power amplifier. By effective use of this bipolar DC power supply, the power amplifier 264 can use push-pull transistors on its final output stage, and eliminate any typically large valued bypass capacitors that would otherwise be required. The output signal of the power amplifier 264 is then communicated to the speaker, which consists of the linear motor 100.

The above amplifiers, including the output stage power amplifier, are all located on the integrated circuit 52. Some of the low-gain amplifier stages use an operational amplifier such as the OP-90, manufactured by Precision Monolithics. The OP-90 is available on a semi-custom chip, or can be, of course, placed on a custom analog chip.

Figure 12:
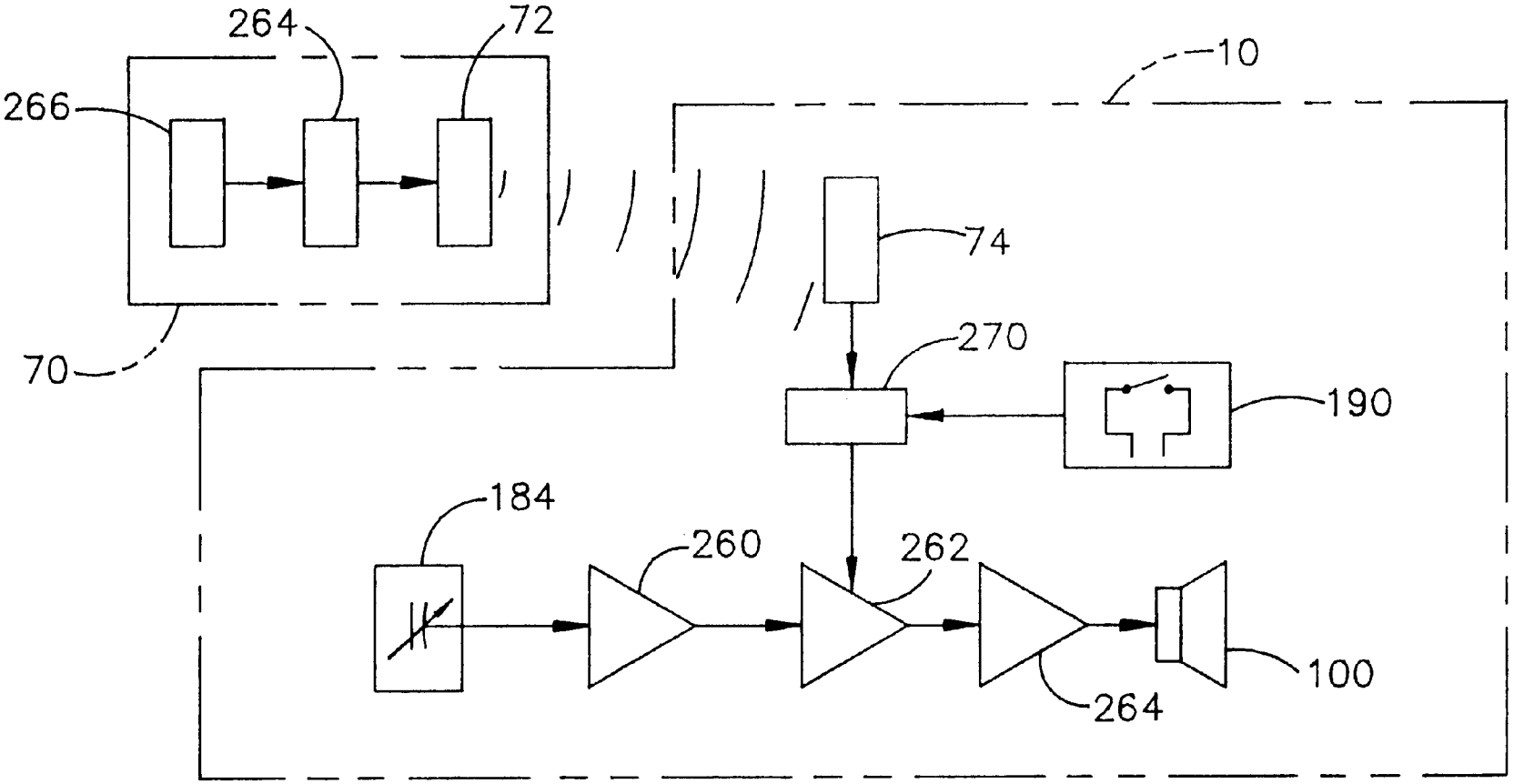
FIG. 12 is an alternative electrical schematic of the hearing aid device of FIG. 1A, in this case, having a remote hand-held controller which communicates to the hearing aid device.

Another embodiment of the invention uses a hand-held transmitter to control the user's input commands to the hearing aid. In FIG. 12 the hand-held transmitter is designated 70, and consists of an operator interface 266, a controller 268, and a transmitter 72. The operator interface 266 could be a key pad, a miniature keyboard, or even an existing design TV remote controller, so that the user can hit certain control keys to adjust the volume control of the hearing aid, or to adjust the treble-base filter. The controller 268 is typically a small microprocessor unit which communicates through the operator interface 266 and then passes commands in a digital code signal format to the transmitter stage 72. The transmitter stage 72 can be of various types.

The various types of transmitters which can be used are as follows: a radio frequency transmitter, which would require some type of antenna built into the hand-held unit, or an infrared transmitter, which would require an infrared light emitting diode, or possibly an ultrasonic transmitter means, which would require some type of high frequency speaker output. Whichever means of communication is utilized, it is designated as 76 on FIG. 12.

The communication means 76 requires a corresponding receiver 74, which is in the hearing aid device 10. The receiver 74 converts the communication signal to electrical signals, which are then passed to the control means 270. The control means 270 is similar in function to the previously discussed control means 216 of FIG. 11, in that it controls the treble-base filter and intermediate gain amplifier 262 of the hearing aid 10. Also included as part of the control signals is a local on/off control function 190. The local on/off control 190 is needed to allow the user to completely turn off electrical power in the hearing aid device 10. As in the previous embodiment, the microphone 184 receives sound energy and converts it to electrical energy, which is passed to the microphone transducer amplifier 260. The output of the transducer amplifier 260 is communicated to the filter and gain amplifier 262, which is now controlled by control means 270, which utilizes the received information from the receiver 74. The electrical signal is then sent to the power amplifier 264, and finally to the speaker element 100. To be effective, the receiver 74 requires an antenna 78.

Figure 13:
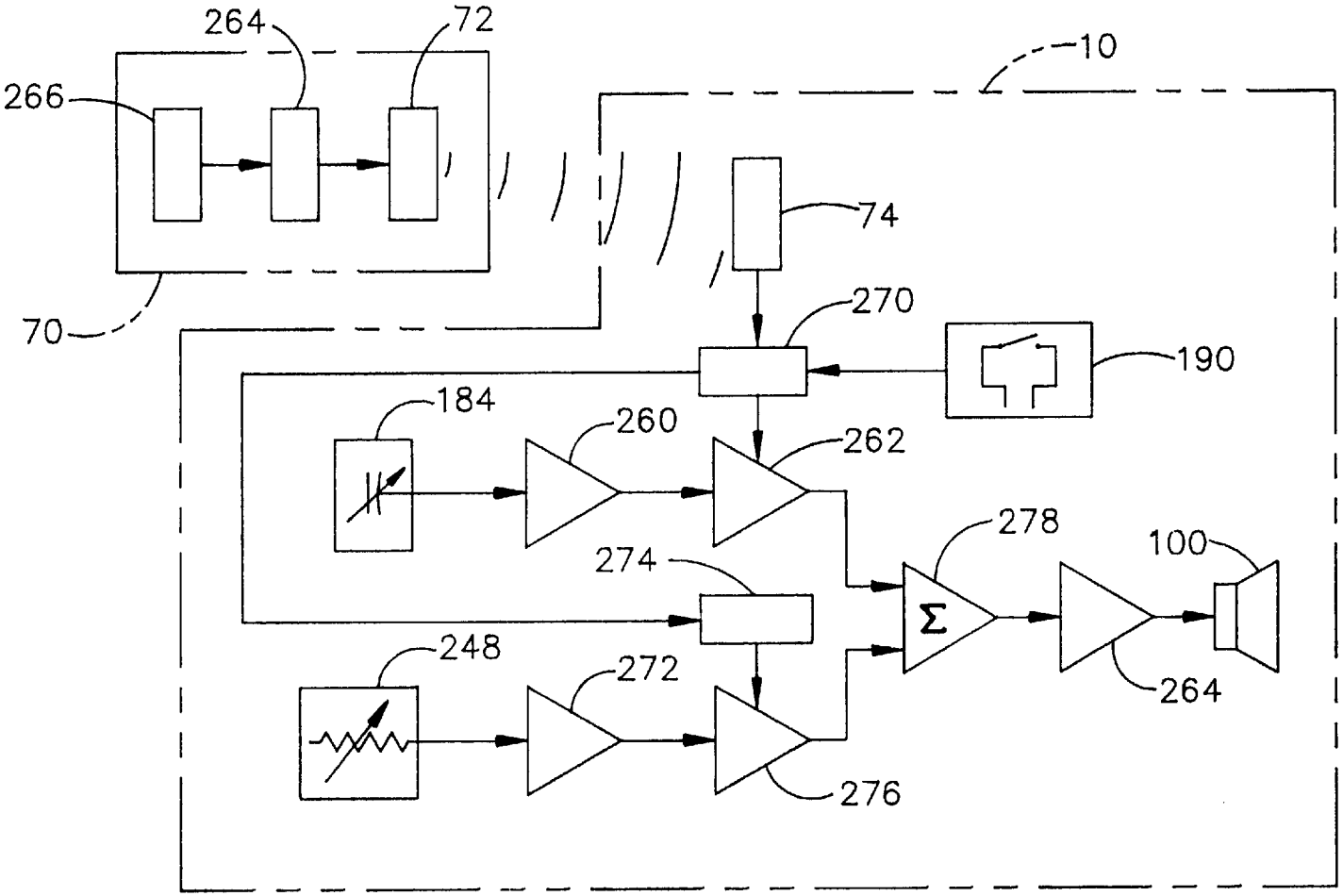
FIG. 13 is another alternative schematic for the hearing aid device of FIG. 1A which, in addition to what is described in FIG. 12, also has a accelerometer input.

Another embodiment of the hearing aid which uses a hand-held transmitter 70 is shown in FIG. 13. This embodiment also includes an accelerometer 248, to either add or subtract conductive sound information. As before, the hand-held transmitter 70 consists of an operator interface 266, a controller 268, and a transmitter 72. The information is communicated by means 76 to the receiver 74 of the hearing aid device 10. Once the information is received by the receiver 74, it is communicated to the control means 270 which also communicates with the local on/off control 190. The sound energy input is received at the microphone 184, and is converted into an electrical signal which is first amplified by the microphone transducer amplifier 260, then modified and amplified by the filter and intermediate gain amplifier 262, and is finally sent to a new amplifier element 278 which is a summation amplifier. The mechanical vibrations are sensed by the accelerometer 248, which converts the vibrations into an electrical signal. This electrical signal is received by the accelerometer transducer amplifier 272, which then outputs the signal to a gain amplifier stage 276. The control means 270 also communicates information to a volume control 274. Volume control 274 controls the gain of amplifier 276, however, the control means 270 also passes a signal to gain amplifier 276 which makes it possible for it to have reverse polarity. Polarity would be reversed in situations where the conductive sound picked up by the accelerometer 248 is to be attenuated. The output of the reversible polarity gain amplifier 276 is then communicated to the summation amplifier 278. At this point the accelerometer signal is either subtracted or added to the microphone signal. The output of summation amplifier 278 is then sent to the power amplifier 264 and then to the speaker element 100.

Figure 14:
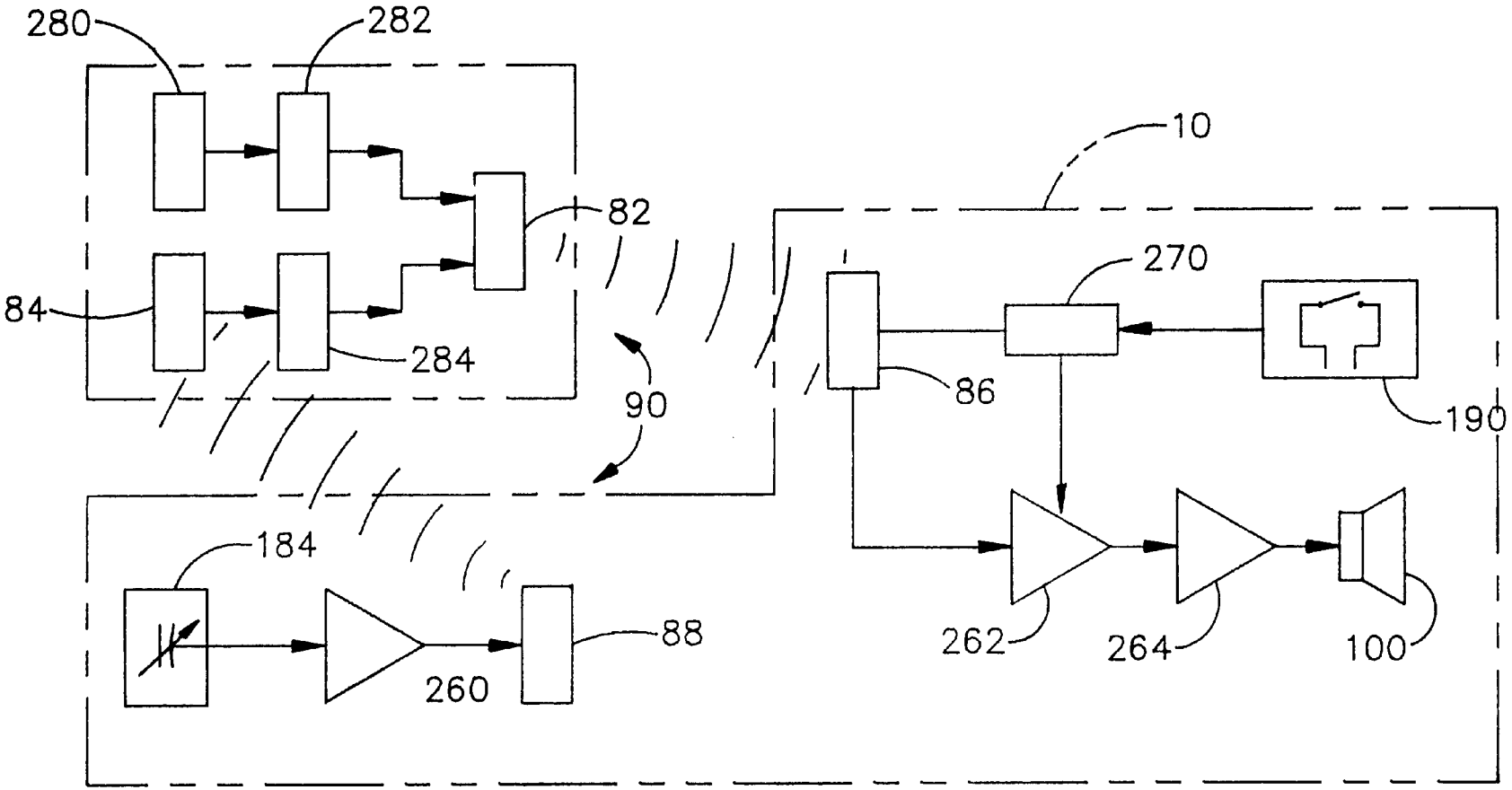
FIG. 14 is another alternative electrical schematic that shows a signal processing unit which is remote to the hearing aid, and is in constant communication with the hearing aid device of FIG. 1A.

Another embodiment of the invention employs signal processing techniques to greatly enhance the performance of the invention for users with special hearing problems. In FIG. 14 there is a portable signal processing device 80, which can be either carried by hand or worn on the clothing (such as strapped to a belt) of the user. To adjust the volume and treble-base controls, the user inputs information through the operator interface 280, which can be a key pad, which information is then communicated to a controller 282. That information is then communicated to the radio frequency transmitter 82. This information would be in the form of digital signals which are then transmitted via communication means 90 to the receiver 86 of the hearing aid 10. At the hearing aid 10, sound energy is picked up by the microphone 184 and converted into electrical signals which are passed to the microphone transducer amplifier 260. The output of the transducer amplifier 260 is sent to a second radio frequency transmitter 88. This information is then communicated via communication means 90 to a second radio frequency receiver 84 which is located on the signal processing device 80. This information is communicated from the output of the receiver 84 to a signal processing controller 284. The signal processor 284 must work as nearly in real time as possible, to accept the audio information from the receiver 84 and then output the processed audio information in the form of an electrical signal to the radio frequency transmitter 82.

As is apparent to those skilled in the art, communication means 90 must be a full duplex means of communicating radio frequency information both to and from each device, the hearing aid 10 and the signal processing device 80. Once the signal is transmitted from the radio frequency transmitter 82 it is received by a radio frequency receiver 86 on the hearing aid device 10. The control portion of the received signal is a digital series of commands 286. These commands are communicated to the control means 270 which also communicates to a local on/off control 190. The audio portion of the received information which is received by radio frequency receiver 86 is an electrical signal 288. This audio signal is communicated to the filter and intermediate gain amplifier 262 which also communicates with the control means 270. The output of the filter and gain amplifier 262 is sent to the power amplifier 264 which outputs the signal to the speaker element 100.

An alternative embodiment of the invention which employs signal processing techniques is one that includes a self-contained enhanced signal processing controller within the hearing aid 10 itself. This embodiment is described in schematic form on FIG. 12, wherein the filter and intermediate gain amplifier 262 also contains the necessary signal processing controller to achieve the desired enhancement.

Figure 15:
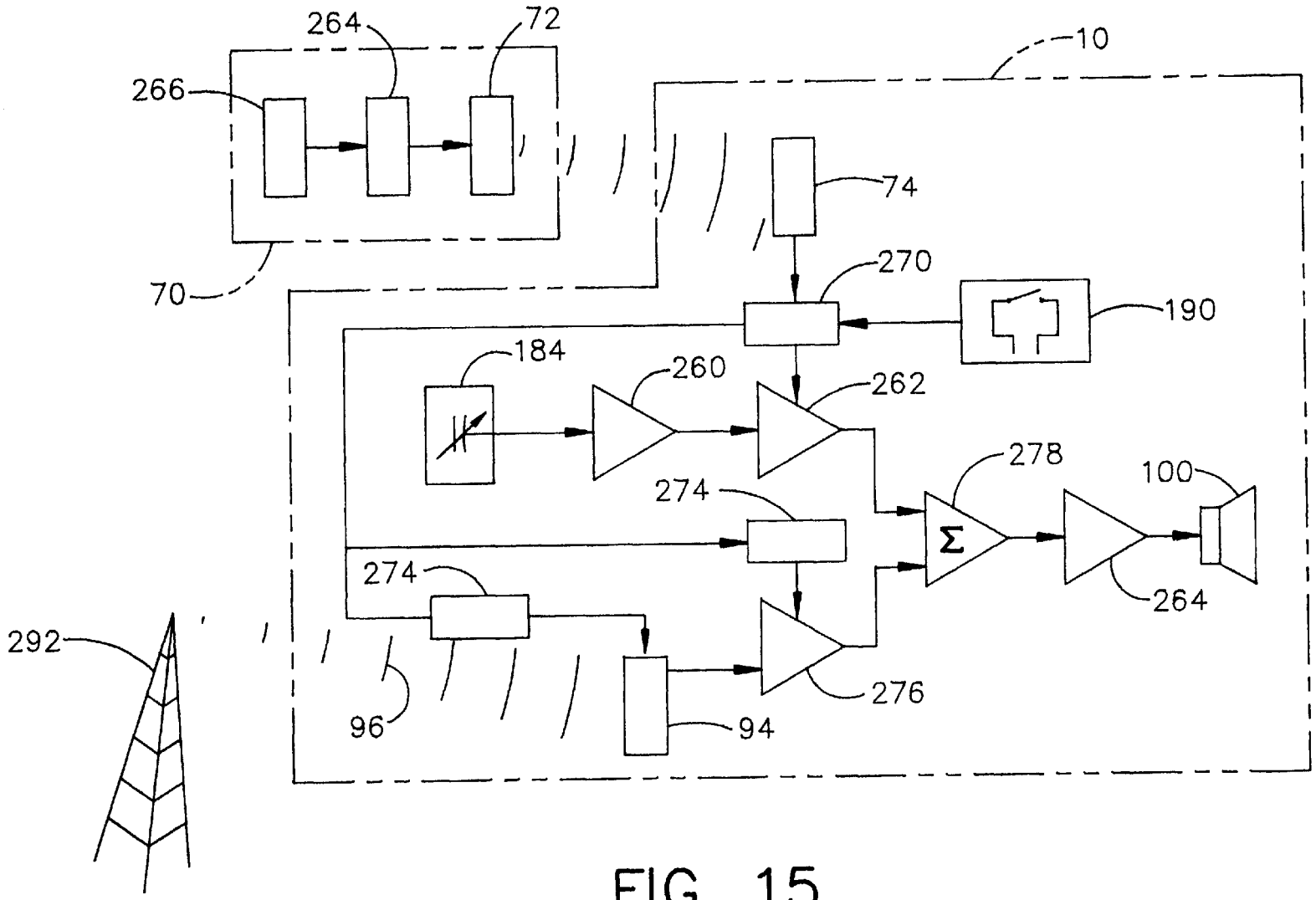
FIG. 15 is an electrical schematic which shows a remote hand-held device which communicates with the hearing aid device of FIG. 1, which in addition, contains a radio receiver.

Another embodiment of the invention can consist of a radio receiver 94 which can receive either commercial broadcast or local broadcast. As illustrated in FIG. 15, this embodiment uses a hand-held transmitter 70, which consists of the elements of the operator interface 266, the controller 268, and the output transmitter 72. Information from the transmitter 72 is communicated by means 76 to a receiver 74 on the hearing aid device 10. In this embodiment, the operator interface 266 can also control the frequency to be received at the hearing aid device 10 receiver 94. That information is transmitted by transmitter 72 via communication means 76 to the receiver 74. This information is subsequently communicated to the control means 270 and then to the tuner 290. The control means 270 also communicates with a local on/off control 190. Sound wave energy is received by the microphone 184 and is converted to an electrical signal which is communicated to the microphone transducer amplifier 260. The output of this transducer amplifier 260 is communicated to the filter and intermediate gain amplifier 262, whose output is then communicated to sound amplifier 278.

The hearing aid device 10 also receives radio frequency information via its receiver 94. Radio frequency receiver 94 can receive commercial broadcasts, for example, in the AM and FM bands of commercial communications, from a commercial transmitter 92 via communication means 96. In the case of a commercial transmitter, control means 270 transfers information to the tuner 290 which then controls which radio station will be received by the radio frequency receiver 94. The output of the receiver 94 is sent to a gain amplifier 276 whose gain is controlled by volume control 274 which communicates to the control means 270. The output of the gain amplifier 276 is then sent to the summation amplifier 278 whose output consists of signals from both the microphone and the radio receiver. The output of the summation amplifier 278 is communicated to the power amplifier 264 which then sends the signal to the speaker element 100. If the user so desires, radio frequency receiver 94 can receive a local broadcast which might consist of a miniature radio transmitter worn by the user which is broadcasting music, for example, from a compact disc player or from a cassette tape player. While such local radio transmitters may not be in use today, they are certainly foreseeable in the future, particularly after the present invention becomes common in the marketplace.

In summary, numerous benefits have been described which result from employing the concepts of the invention. The overall size, shape, and orientation of the hearing apparatus provide a package which fits deeply into the external auditory canal such that its microphone is placed at the acoustic focus of the concha, and its speaker is placed between the sigmoid portion of the canal and the tympanic membrane. Such placement of the speaker, along with sealing the air inside the external auditory canal around the hearing apparatus, achieves a closely-coupled system. The hearing apparatus can be used as a stand-alone device which includes all necessary signal-conditioning and amplification electronic circuitry, as well as enhanced signal processing, if so desired. The hearing apparatus also can be used in conjunction with a separate hand-held transmitter for controlling various operational functions, a separate enhanced signal processing device, if desired, or used in communication with a radio transmitter.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A hearing aid adapted for use with a human ear having an external sound collecting surface and an auditory canal, the canal having a tympanic membrane at its innermost terminus, a bony canal portion extending outward from the tympanic membrane to an anatomical position where the canal continues as a cartilaginous part, said cartilaginous part having a S-shaped sigmoid portion and an outermost canal entrance portion, the sigmoid portion being anatomically deep relative to the entrance portion, the entrance portion extending to a tragus, said canal entrance portion providing access to the auditory canal for airborne sound, said canal entrance being opposite to a conchal bowl which collects and aims sound that has been captured by the external sound collecting surface toward said canal entrance portion, the hearing aid comprising:

(a) a microphone for receiving airborne sound, said microphone being placed within the auditory canal and being positioned anatomically deep relative to both the tragus and the outermost entrance to the external auditory canal with its receiving surface facing the conchal bowl, said microphone being operative to produce electrical signals in response to the airborne sound waves it receives;

(b) an electronic circuit operative to produce a processed output signal in response to the electrical signals produced by the microphone; and (c) a speaker positioned in the external auditory canal responsive to the output signal of the electronic circuit for converting the output signal into sound waves.

2. A hearing aid as recited in claim 1 wherein said microphone is a piezo-electric device.

3. A hearing aid as recited in claim 1 wherein said microphone is an electret device.

* * * * *

UNITED STATES PATENT AND TRADEMARK OFFICE

CERTIFICATE OF CORRECTION

PATENT NO. : 6,041,129
DATED : March 21, 2000
INVENTOR(S) : Roger A. Adelman

It is certified that error appears in the above-identified patent and that said Letters Patent is hereby corrected as shown below:

On the cover page, in the Related U.S. Application Data, between "abandoned" and the period, insert --which is a continuation of application Serial No. 08/049,875, filed April 19, 1993, now U.S. Patent No. 5,390,254, which is a continuation of application Serial No. 07/642,735, filed January 17, 1991, now abandoned.--

On column 1, line 4, between "abandoned" and the period, insert --which is a continuation of application Serial No. 08/049,875, filed April 19, 1993, now U.S. Patent No. 5,390,254, which is a continuation of application Serial No. 07/642,735, filed January 17, 1991, now abandoned.--

Column 18, line 65, please add the following claims:

--4. A hearing aid as recited in claim 1 wherein the receiving surface includes a diaphragm.--

--5. A hearing aid as recited in claim 4 wherein the receiving surface further includes a structure with a port facing the conchal bowl for allowing acoustic energy to be presented to the diaphragm.--

--6. A hearing aid as recited in claim 5 wherein the diaphragm faces the conchal bowl.--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*